US005364449A

United States Patent [19]

Nakamura et al.

[11] Patent Number: 5,364,449

[45] Date of Patent: Nov. 15, 1994

[54] PROCESS FOR REFINING CRUDE MATERIAL FOR COPPER OR COPPER ALLOY

[75] Inventors: Takashi Nakamura, Fukuoka; Kenji Osumi, Kobe; Kiyomasa Oga, Kobe; Motohiro Arai, Kobe; Ryukichi Ikeda, Shimonoseki; Eiji Yoshida, Shimonoseki; Hirofumi Okada, Shimonoseki; Ryusuke Hamanaka, Shimonoseki, all of Japan

[73] Assignee: Kabushiki Kaisha Kobe Seiko Sho, Kobe, Japan

[21] Appl. No.: 988,960

[22] PCT Filed: Mar. 25, 1992

[86] PCT No.: PCT/JP92/00358

§ 371 Date: Mar. 15, 1993

§ 102(e) Date: Mar. 15, 1993

[87] PCT Pub. No.: WO93/02219

PCT Pub. Date: Feb. 4, 1993

[30] Foreign Application Priority Data

| | | | |
|---|---|---|---|
| Jul. 15, 1991 | [JP] | Japan | 3-199985 |
| Oct. 28, 1991 | [JP] | Japan | 3-308534 |
| Oct. 28, 1991 | [JP] | Japan | 3-308535 |
| Oct. 28, 1991 | [JP] | Japan | 3-308536 |

[51] Int. Cl.[5] ..... C22B 15/14

[52] U.S. Cl. ..... 75/650; 75/651; 75/652

[58] Field of Search ..... 75/650, 651, 652

[56] References Cited

U.S. PATENT DOCUMENTS

| | | | |
|---|---|---|---|
| 3,682,623 | 8/1972 | Dierckx et al. . | |
| 3,744,992 | 7/1973 | Lundquist | 75/650 |
| 4,318,737 | 3/1982 | Canning, Jr. . | |

FOREIGN PATENT DOCUMENTS

| | | |
|---|---|---|
| 0185004 | 6/1986 | European Pat. Off. . |
| 2665183 | 1/1992 | France . |
| 51-133125 | 11/1976 | Japan . |
| 52-146718 | 6/1977 | Japan . |
| 54-12409 | 5/1979 | Japan . |
| 58-27939 | 2/1983 | Japan . |
| 59-211541 | 11/1984 | Japan . |
| 59-226131 | 12/1984 | Japan . |
| 60-162737 | 8/1985 | Japan . |
| 61-217538 | 9/1986 | Japan . |
| WO81/01297 | 5/1981 | WIPO . |

OTHER PUBLICATIONS

Database WPI, Derwent Publications Ltd., AN 93-165432, SU-A-1 735 410, May 23, 1992.

Database WPI, Derwent Publications Ltd., AN 85-049378, SU-A-1 105 512, Jul. 30, 1984.

*Primary Examiner*—Melvyn J. Andrews

*Attorney, Agent, or Firm*—Oblon, Spivak, McClelland, Maier & Neustadt

[57] ABSTRACT

A process for refining a crude material for copper or copper alloy which contains as impurity elements at least one species of Pb, Ni, Sb, S, Bi, and As in combination with at least one species of Sn, Fe, and Zn, which comprises the sequential steps of (1) melting a crude material for copper or copper alloy, (2a) increasing the oxygen concentration in the melt, thereby oxidizing Sn, Fe, and Zn into slag, (this step is carried out if the crude material contains as impurity elements at least one species of Sn, Fe, and Zn) (2b) adding to the melt at least one species selected from the group consisting of Fe, Fe oxide, Mn, and Mn oxide, thereby causing Pb, Ni, Sb, S, Bi, and As in the melt to slag in the form of compound oxide of Fe and/or Mn, (3) removing the thus formed slag from the melt, and (4) subjecting the melt to reduction.

24 Claims, 22 Drawing Sheets

PROCESS FOR REFINING CRUDE MATERIAL FOR COPPER OR COPPER ALLOY

TECHNICAL FIELD

The present invention relates to a process for refining a crude material for copper or copper alloy, and more particularly to a process for efficiently removing impurity elements, such as Pb, Ni, Sb, S, Bi, As, Fe, Sn, and Zn, from a crude material for copper or copper alloy.

BACKGROUND ART

Because of its good thermal and electrical conductivity, copper or copper alloy is used in large quantities as an indispensable material for electric and electronic parts and heat exchanger and many other products. Its higher price than iron and its limited ore reserves necessitate, from the standpoint of effective resource usage, the recovery and recycling of its scrap produced from its use or machining. However, scrap copper cannot be recycled as such be:cause it contains a large amount of impurities such as foreign metals, solder, plating, and insulating materials. The common way of removing impurities from scrap copper is by manual separation and subsequent magnetic separation before its melting. Manual separation is limited in capacity and magnetic separation does not work on impurity elements in the form of solder, plating, or alloy components (such as Pb, Ni, Sb, S, Bi, As, Fe, Sn, and Zn). To cope with this situation, there was proposed a process for refining scrap copper by subjecting the melt of scrap copper to oxidation or reduction or to slagging by the aid of flux, thereby removing impurity elements. (Japanese Patent Publication Nos. 12409/1979 and 43094/1981 and Japanese Patent Laid-open Nos. 133125/1976, 27939/1983, 211541/1984, 226131/1984, and 217538/1986.) Improvement on this method has continued since its appearance. Of the above-mentioned methods, the one disclosed in Japanese Patent Laid-open No. 217538/1986 seems to be most effective. It consists of melting copper scrap, adding a small amount of phosphorus to the melt, performing oxidation to float impurity elements together with part of phosphorus oxide, removing residual phosphorus by oxidation while keeping the melt in a highly oxidative state, and finally removing oxygen by reduction. With this method, it is comparatively easy to remove Fe, Sn, and Zn, but it is hard to remove Pb, Ni, Sb, S, Bi, and As. Moreover, it poses a problem associated with contamination with a considerable amount of phosphorus.

The present invention was completed in view of the foregoing. It is an object of the present invention to provide a process for refining scrap copper or crude copper (called blister copper) by efficient removal of impurity elements such as Pb, Ni, Sb, S, Bi, As, Fe, Sn, and Zn in the course of melting, thereby recovering high-quality copper.

DISCLOSURE OF THE INVENTION

The present invention is embodied in a process for refining a crude material for copper or copper alloy which contains at least one species of Pb, Ni, Sb, S, Bi, and As which comprises the sequential steps of (1) melting a crude material for copper or copper alloy, (2) increasing the oxygen concentration in the melt and adding to the melt at least one species selected from the group consisting of Fe, Fe oxide, Mn, and Mn oxide, there-by causing Pb, Ni, Sb, S, Bi, and As in the melt to slag in the form of .compound oxide of Fe and/or Mn, (3) removing the thus formed slag from the melt, and (4) subjecting the melt to reduction.

The present invention is also embodied in a process for refining a crude material for copper or copper alloy which contains at least one species of Pb, Ni, Sb, S, Bi, and As in combination with at least one species of Sn, Fe, and Zn which comprises the sequential steps of (1) melting a crude material for copper or copper alloy, (2a) increasing the oxygen concentration in the melt, thereby oxidizing Sn, Fe, and Zn into slag, (2b) adding to the melt at least one species selected from the group consisting of Fe, Fe oxide, Mn, and Mn oxide, thereby causing Pb, Ni, Sb, S, Bi, and As in the melt to slag in the form of compound oxide of Fe and/or Mn, (3) removing the thus formed slag from the melt, and (4) subjecting the melt to reduction.

The step (2a) mentioned above is carried out such that the oxygen concentration in the melt increases to 500 ppm or above. This permits the efficient slagging of Sn, Fe, and Zn for their separation. In the step (2) or (2b) mentioned above, at least one of Fe, Fe oxide, Mn, and Mn oxide (preferably Fe and/or Fe oxide) is added in an amount of 10–50000 ppm of the weight of the melt. They are scattered over the surface of the melt and mixed with the melt by stirring (with bubbling of an inert gas). The resulting slag in the form of compound oxide floats on the surface of the melt. In this way it is possible to efficiently remove Pb, Ni, Sb, S, Bi, and As from the melt.

In the step (3) mentioned above, it is desirable that after the formation of compound oxide the melt be allowed to stand prior to slagging. For effective slagging, it is advisable to add an $SiO_2$—$Al_2O_3$ flux (composed of 70–90 parts by weight of $SiO_2$ and 30–10 parts by weight of $Al_2O_3$) in an amount of 0,005–0.10% of the weight of the melt.

In the step (4) mentioned above, reduction should be accomplished by the addition of a solid or gaseous reducing agent (the former being preferable) and the simultaneous blowing of an inert gas.

BEST MODE FOR CARRYING OUT THE INVENTION

Figure 1:
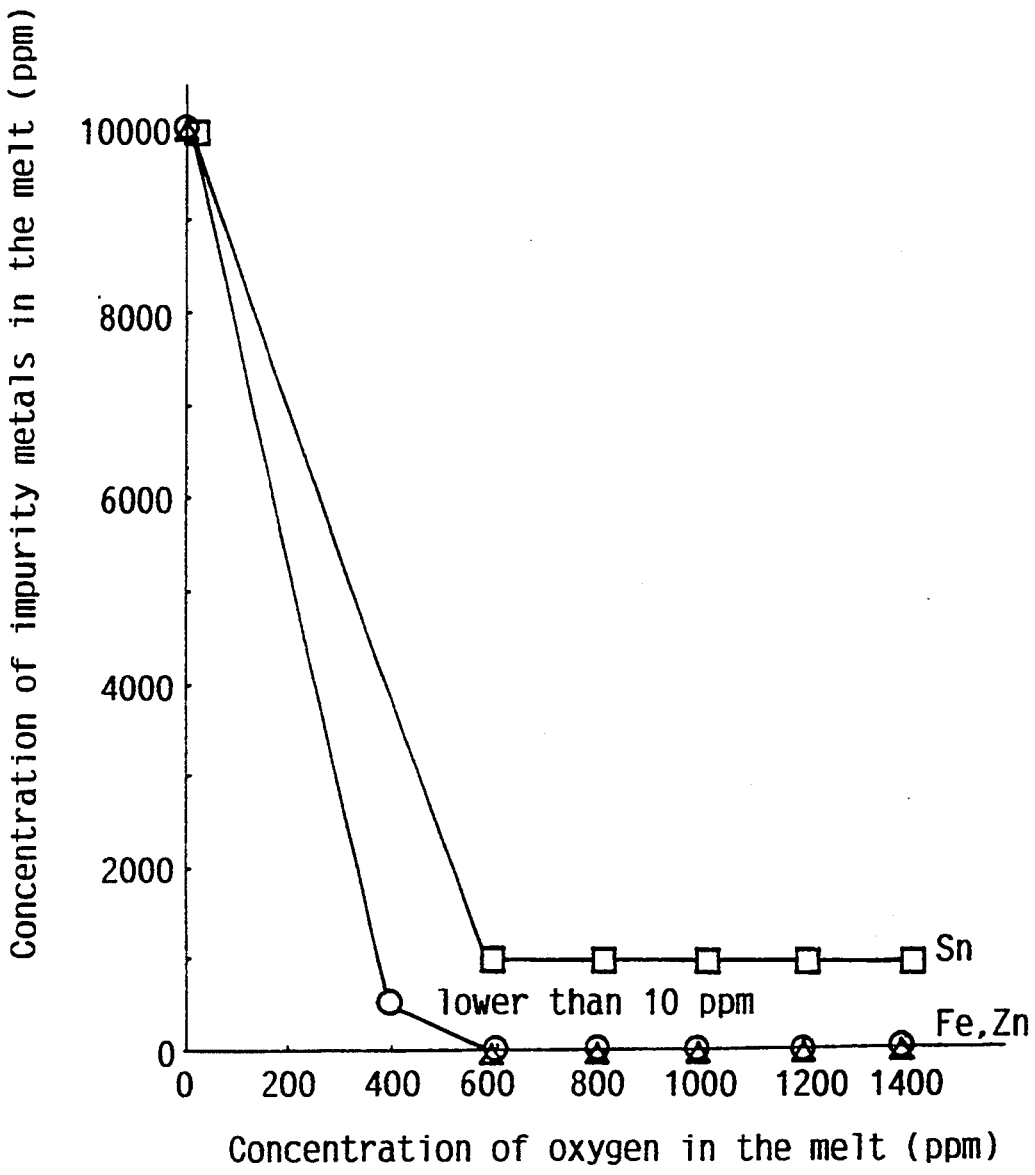
FIG. 1 is a graph showing the relationship between the oxygen concentration in the melt after oxidation by the step (2a) and the concentration of impurity metals in the melt.

Scrap copper as a crude material for copper or copper alloy contains impurity elements such as Pb, Ni, Sb, S, Bi, As, Sn, Fe, and Zn. Of these elements, the last three are easy to remove because when the melt of a crude material is fed with a gaseous oxygen source (such as oxygen or air) or a solid oxygen source (such as CuO), they undergo oxidation to give rise to easily removable oxides floating on the surface of the melt.

By contrast, the remainder of the impurity elements are difficult to remove by mere oxidation of the melt. Their removal needs more other means than mentioned above. According to the present invention, this is accomplished in two steps. The first step is for the removal of Sn, Fe, and Zn by oxidation, and the second step is for the removal of Pb, Ni, Sb, S, Bi, and As by slagging into compound oxides of Fe and/or Mn with the aid of a flux selected from the group consisting of Fe, Fe oxide, Mn, and Mn oxide (referred to as Fe (Mn) flux hereinafter). In the final step, after the removal of slag, the melt undergoes reduction for the removal of oxygen to give copper free from impurity elements. When applied to a crude material containing at least one species of Pb, Ni, Sb, S, Bi, and As but not containing Fe, Sn, and Zn, the process of the present invention consists of four sequential steps (1), (2), (3), and (4). When applied to a crude material containing at least one species of Pb, Ni, Sb, S, Bi, and As and also containing Fe, Sn, and Zn, the process of the present invention consists of five sequential steps (1), (2a), (2b), (3), and (4). A detail description of each step is given in the following.

STEP (1)

The process of the present invention starts with this first step, which is intended to melt a crude material for copper. The crude material includes scrap copper and blister copper, the former being recovered from electric copper wire (with coating burned off), Ni-plated copper wire, heat exchanger (fins, plates, pipes, etc.) , and cutting chips. A crude material may be combined with the melt remaining after copper refining or casting. The melting may be accomplished by means of an induction melting furnace or reverberatory furnace.

STEP (2a)

This step is employed in the case where the crude material contains at least one species of Fe, Sn, and Zn. It is intended to feed the melt with a solid and/or gaseous oxygen source, thereby increasing the oxygen concentration in the melt and changing Sn, Fe, and Zn into oxide slag. Being readily oxidizable, Sn, Fe, and Zn form floating oxide slag which can be easily removed from the melt. The solid oxygen source is CuO and the gaseous one is oxygen or air (in most cases), with the latter being preferable because of its ability to oxidize gaseous Zn evolved from the melt by evaporation.

The solid oxygen source may be scattered over the surface of the melt or blown into the melt by the aid of a carrier gas, the latter method being more efficient. The gaseous oxygen source may be blown toward the surface of the melt or preferably blown into the melt. They may be used alone or in combination with each other. For example, it is possible to scatter the solid oxygen source over the surface of the melt while blowing the gaseous one into the melt. Alternatively, it is also possible to blow into the melt the gaseous oxygen source together with the solid one.

For the efficient removal of Fe, Sn, and Zn from the melt by oxidation slagging, it is necessary to control the amount of the solid and/or gaseous oxygen source such that the oxygen concentration in the melt is higher than 500 ppm. This will be understood from FIG. 1 which shows the relationship between the oxygen concentration in the melt and the concentration of impurity metals in the melt, in the case where a crude material (Cu, 1 wt. % Fe, 1 wt. % Sn, 1 wt. % Zn, 1 wt. % Pb) was melted under the atmosphere in a 3-ton induction melting furnace and air in varied amount was blown into the melt.

Figure 2:
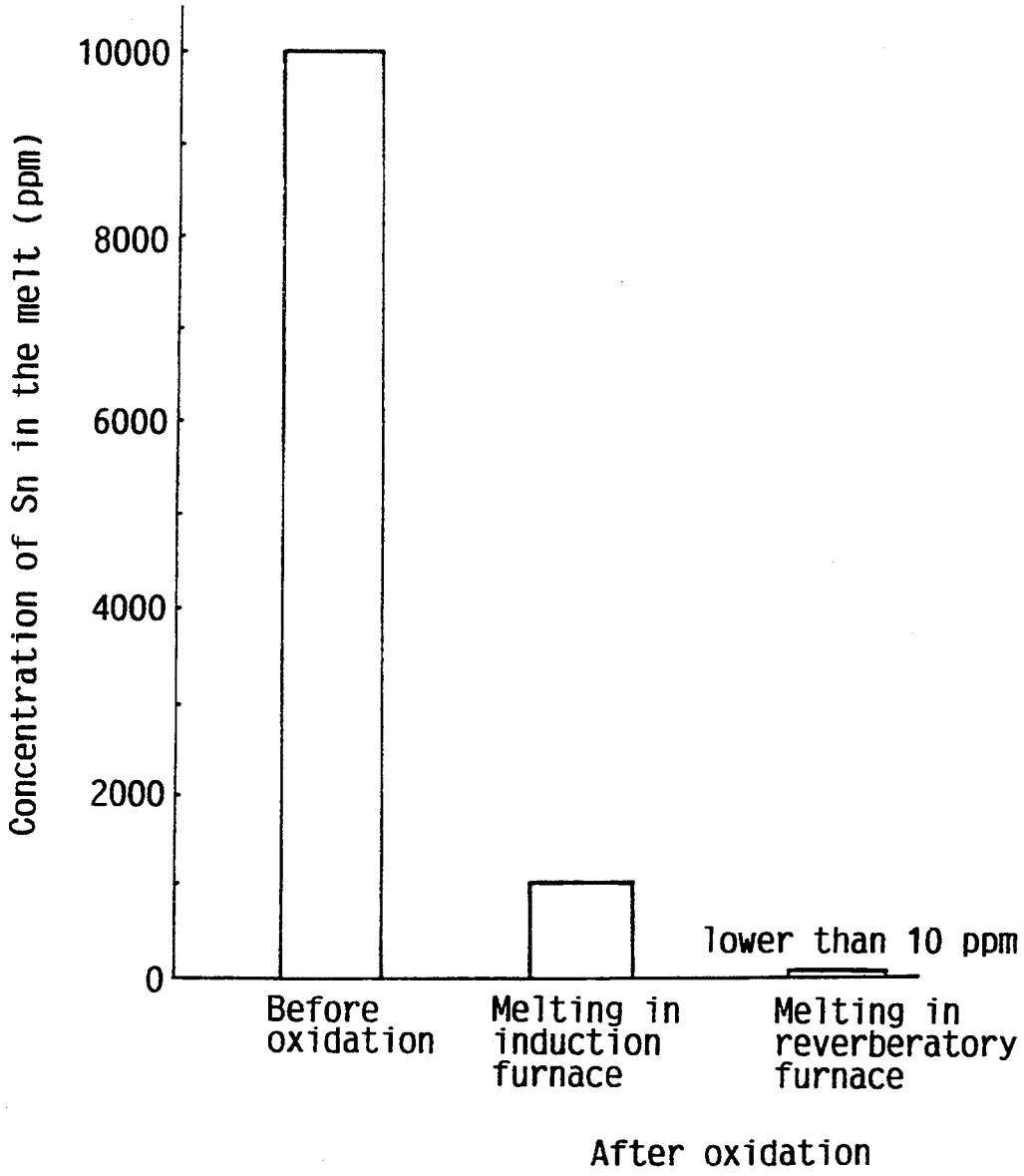
FIG. 2 is a graph showing the comparison of the Sn concentration in the melt in the case where oxidation by the step (2a) is carried out in an induction melting furnace or reverberatory furnace.

It is to be noted from FIG. 1 that the concentration of Sn decreases to about 1000 ppm when the oxygen concentration increases to 600 ppm but the former remains unchanged even though the latter increases further. Presumably, this is because oxidation forms Sn oxides (SnO and $SnO_2$) in the form of extremely fine particles (of the order of several μm in diameter) which remain suspending in the melt but do not float when the melt is subject to vigorous stirring as in an induction melting furnace. For such fine particles of Sn oxides to float, it is necessary to allow the melt to stand for a while after oxidation. The results are shown in FIG. 2. It is to be noted that in the case where the melt was allowed to stand for about 1 hour after oxidation (the blowing of air), the Sn concentration in the melt decreased to 10 ppm or less, which is nearly equal to the concentrations of Fe and Zn.

Figure 3:
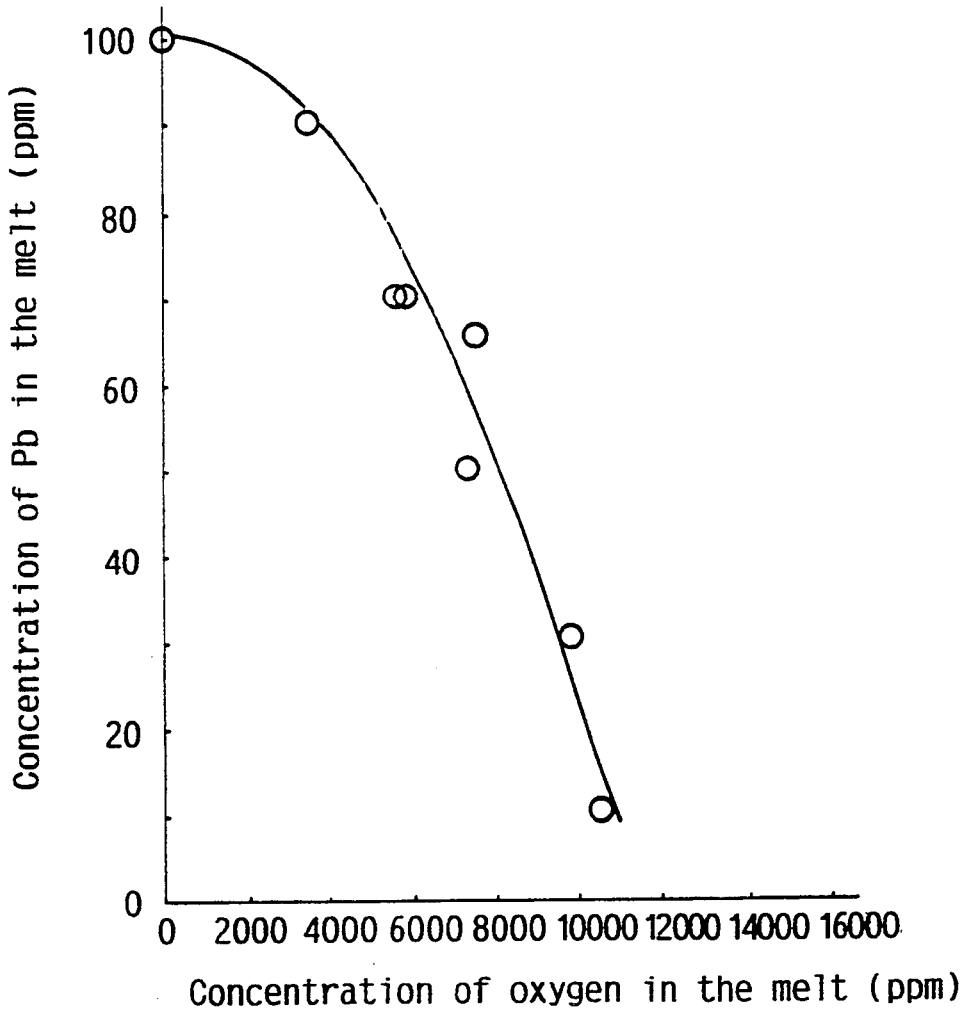
FIG. 3 is a graph showing the relationship between the oxygen concentration in the melt and the Pb concentration in the melt which changes in the step (2a).

An experiment similar to that mentioned above was conducted to see the relationship between the oxygen concentration in the melt (which varies by oxidation) and the Pb concentration in the melt. The results are shown in FIG. 3. It is to be noted that it is difficult to remove Pb from the melt by mere oxidation but it is necessary to feed the melt with a large amount of oxygen source. This is also true of Ni. (It was found that Ni is harder than Pb to remove.)

Since the oxidation step is intended to remove Fe, Sn, and Zn from the melt, it may be omitted if the crude material contains no such impurity metals.

The slag formed in this step may be removed before the subsequent step or left unremoved until the subsequent step is completed and removed in the step (3).

STEP (2) OR (2b)

This step is intended to remove Pb, Ni, Sb, S, Bi, and As from the melt by adding to the melt at least one species selected from the group consisting of Fe, Fe oxide, Mn, and Mn oxide. The results of the present inventors' investigation indicate that these impurity elements cannot be removed by mere oxidation of the melt because their weaker tendency toward oxidation than Fe, Sn, and Zn. It turned out, however, that when the melt is fed with at least one species of Fe, Fe oxide, Mn, and Mn oxide, they form compound oxides with Fe and/or Mn, which float on the surface of the melt and can be removed easily. As FIG. 4 shows, this is apparent from experiments on the removal of Ni from a melt of scrap copper containing 1000 ppm Ni after air blowing to raise the oxygen concentration in the melt to 10000 ppm, with or without the addition of Fe to the melt, It is to be noted that removal of Ni is almost impossible by mere air blowing into the melt but efficient removal of Ni is possible if air blowing precedes the addition of Fe to the melt.

Figure 5:
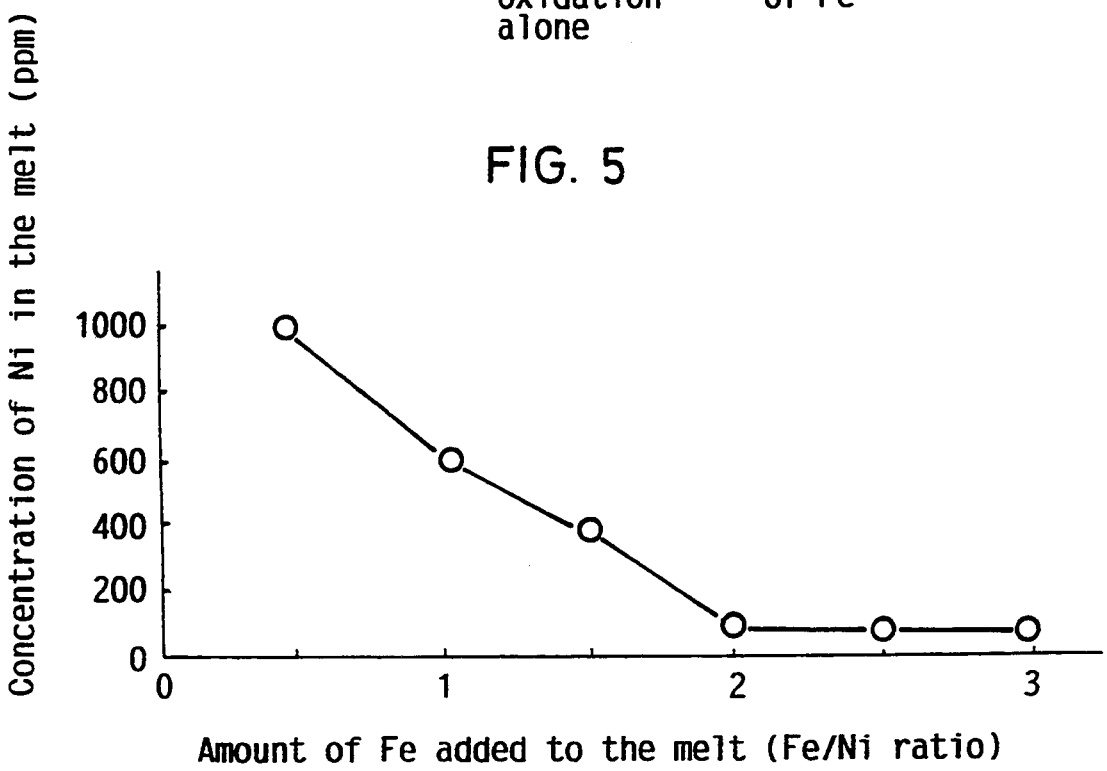
FIG. 5 is a graph showing the relationship between the amount of Fe added in the step (2) or (2b) and the Ni concentration in the melt.

The concentration of Ni in the melt depends on the amount of Fe added to the melt as shown in FIG. 5 (with the melt temperature kept at 1200° C. and the oxygen concentration fixed at 10000 ppm). It is noted that for efficient removal of Ni it is necessary to add to the melt more than twice as much Fe as Ni present in the melt.

Figure 6:
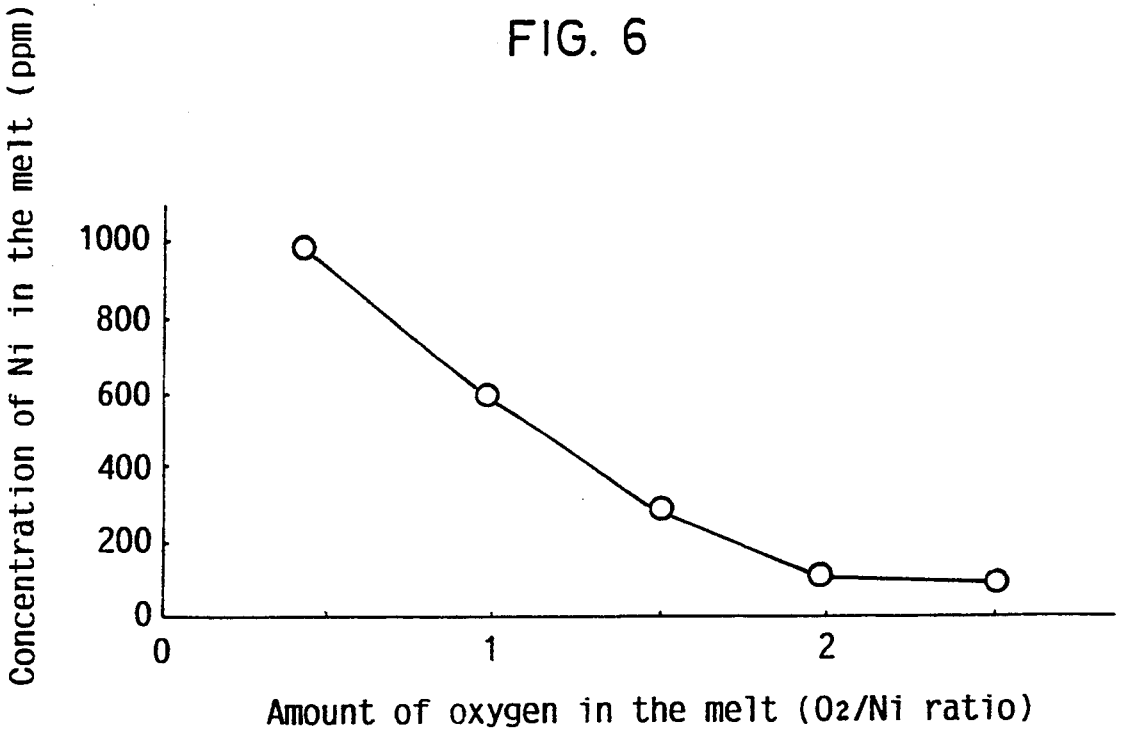
FIG. 6 is a graph showing the relationship between the oxygen concentration in the melt and the Ni concentration in the melt which changes as the result of the step (2) or (2b).

The concentration of Ni in the melt depends also on the oxygen concentration in the melt as shown in FIG. 6 (with the melt temperature kept at 1200° C., the amount of Fe fixed at four times the Ni concentration in the melt, and the oxygen concentration adjusted by the amount of air blowing). It is noted that for efficient removal of Ni from the melt it is necessary that the oxygen concentration in the melt should be higher than twice as much as the Ni concentration.

Figure 4:
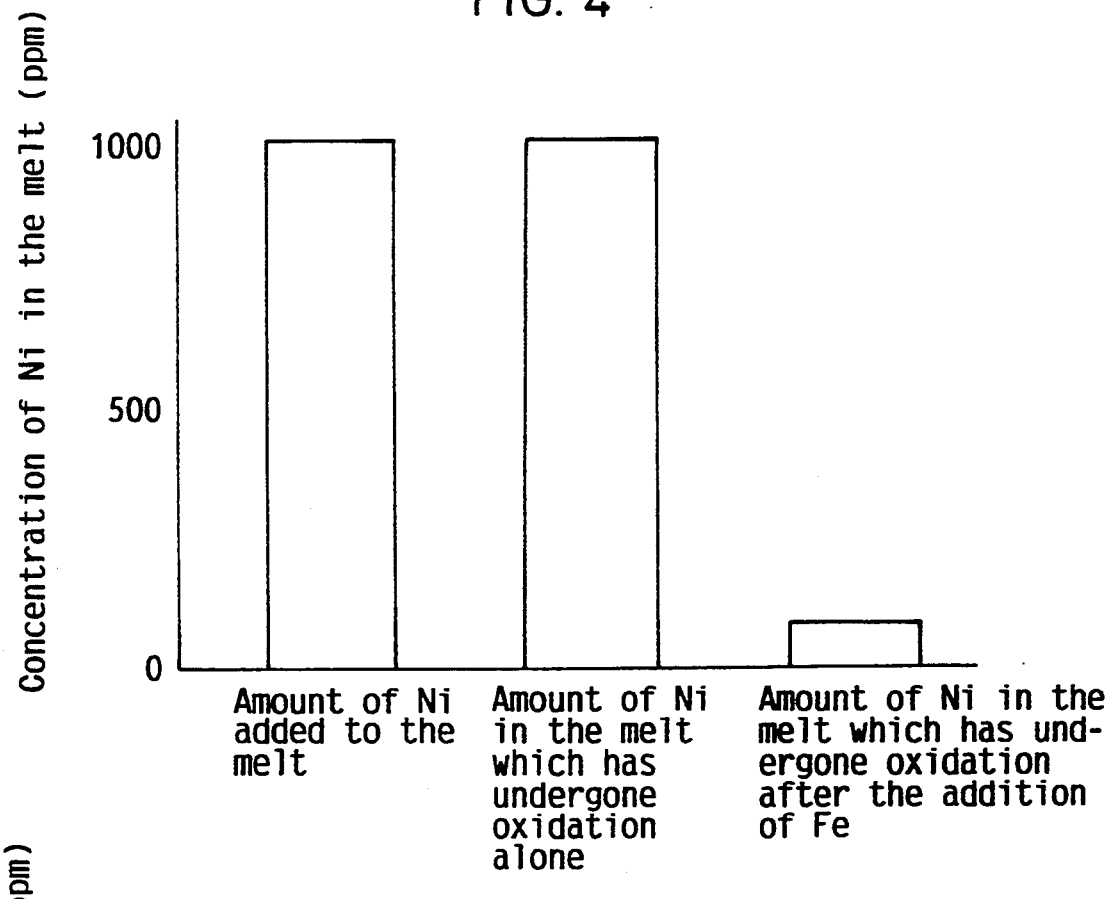
FIG. 4 is a graph showing the comparison of the Ni concentration in the melt which has undergone the step (2a) alone for oxidation with that in the melt which has undergone the subsequent step (2) or (2b) for the formation of compound oxide.

Almost the same results as shown in FIGS. 4 to 6 were obtained even when Fe was replaced by Mn and the procedure was applied to removal of Pb from the melt. Analyses of the slag indicate that Ni (or Pb) separates and floats on the melt in the form of compound oxide composed of Fe oxide (or Mn oxide) and Ni (or Pb) attached thereto or dissolved therein.

The foregoing is about the removal of Ni (or Pb) in the form of compound oxide of Fe (or Mn) by the addition of Fe (or Mn) which precedes air blowing. The same results as above are obtained even when Fe (or Mn) is replaced by its oxide. In addition, the same procedure as above may be applied to the removal of Sb, S, Bi, and As.

There are the following four possible ways of using Fe oxide (or Mn oxide).

(1) Scattering Fe oxide (or Mn oxide) over the surface of the melt.
(2) Scattering Fe oxide (or Mn oxide) over the surface of the melt and stirring the melt by induction heating or bubbling with an inert gas (such as Ar).
(3) Scattering part of Fe oxide (or Mn oxide) over the surface of the melt and blowing the remainder into the melt together with an inert gas.
(4) Blowing all of Fe oxide (or Mn oxide) into the melt together with an inert gas.

The third method is most desirable and the second method is next for the efficient removal of Ni (or Pb, Sb, S, Bi, and As). The fourth method is not effective in the removal of Ni (or Pb, Sb, S, Bi, and As). The first method is fairly effective in the removal of Ni (or Pb, Sb, S, Bi, and As). However, the second and third methods have a disadvantage that part of Fe oxide (or Mn oxide) dissolves in the melt to hinder refining. Therefore, the first method is most desirable. These results were confirmed by experiments as shown below.

Figure 7:
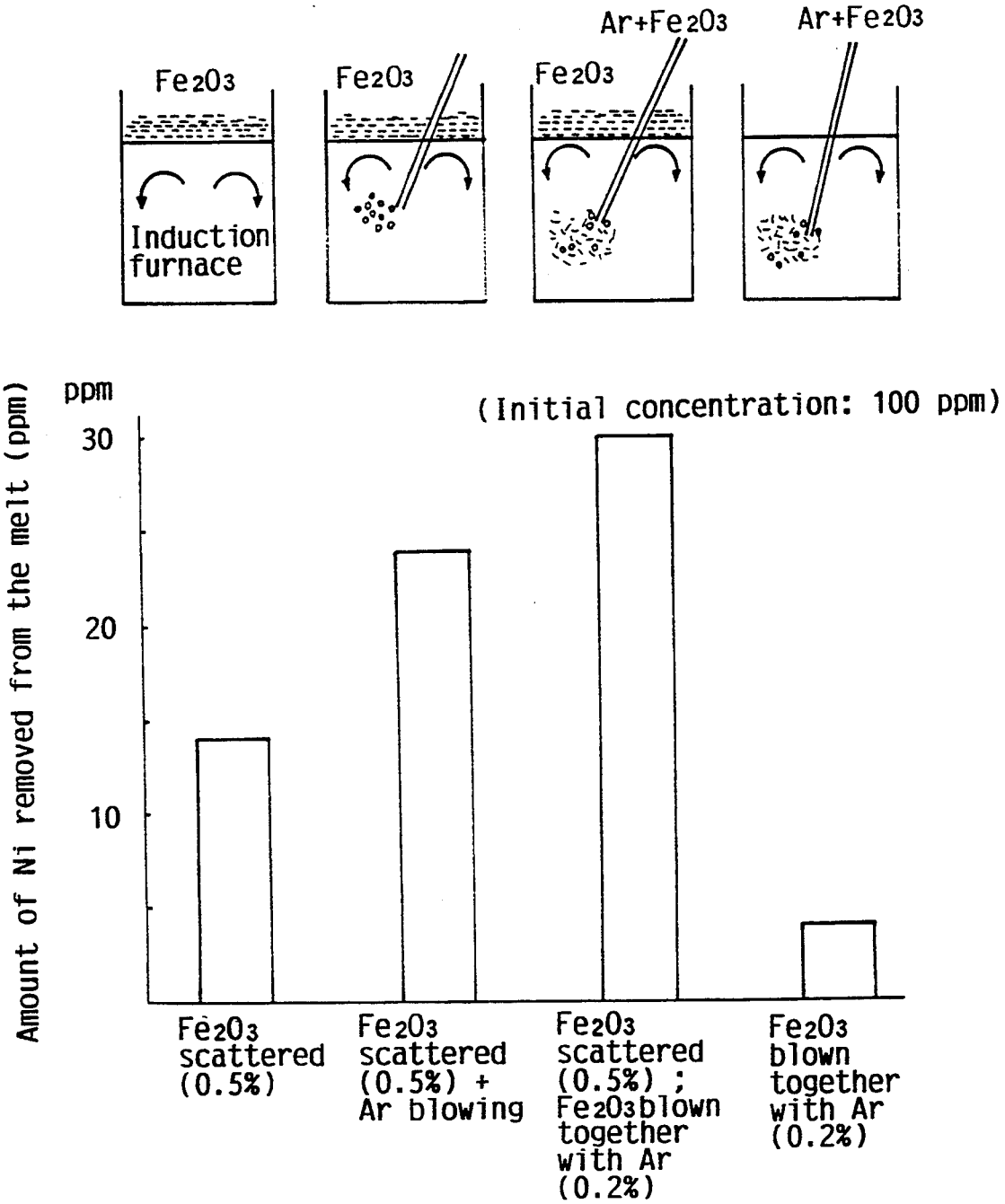
FIG. 7 is a graph showing how the way of adding Fe oxide in the step (2) or (2b) affects the removal of Ni from the melt.

The effect of the way of adding $Fe_2O_3$ to the melt on the removal of Ni was investigated using a melt of crude material for copper (at 1200° C.) containing 100 ppm Ni. The results are shown in FIG. 7. The four ways employed are ranked as follows in terms of Ni removal efficiency.

(1) Scattering of part of $Fe_2O_3$ and blowing of Ar together with the remainder of $Fe_2O_3$ which are carried out simultaneously.
(2) Scattering of $Fe_2O_3$ and blowing of Ar which are carried out simultaneously.
(3) Scattering of $Fe_2O_3$ in combination with stirring of the melt by induction heating or Ar bubbling.
(3) Blowing of Ar together with $Fe_2O_3$.

Figure 8:
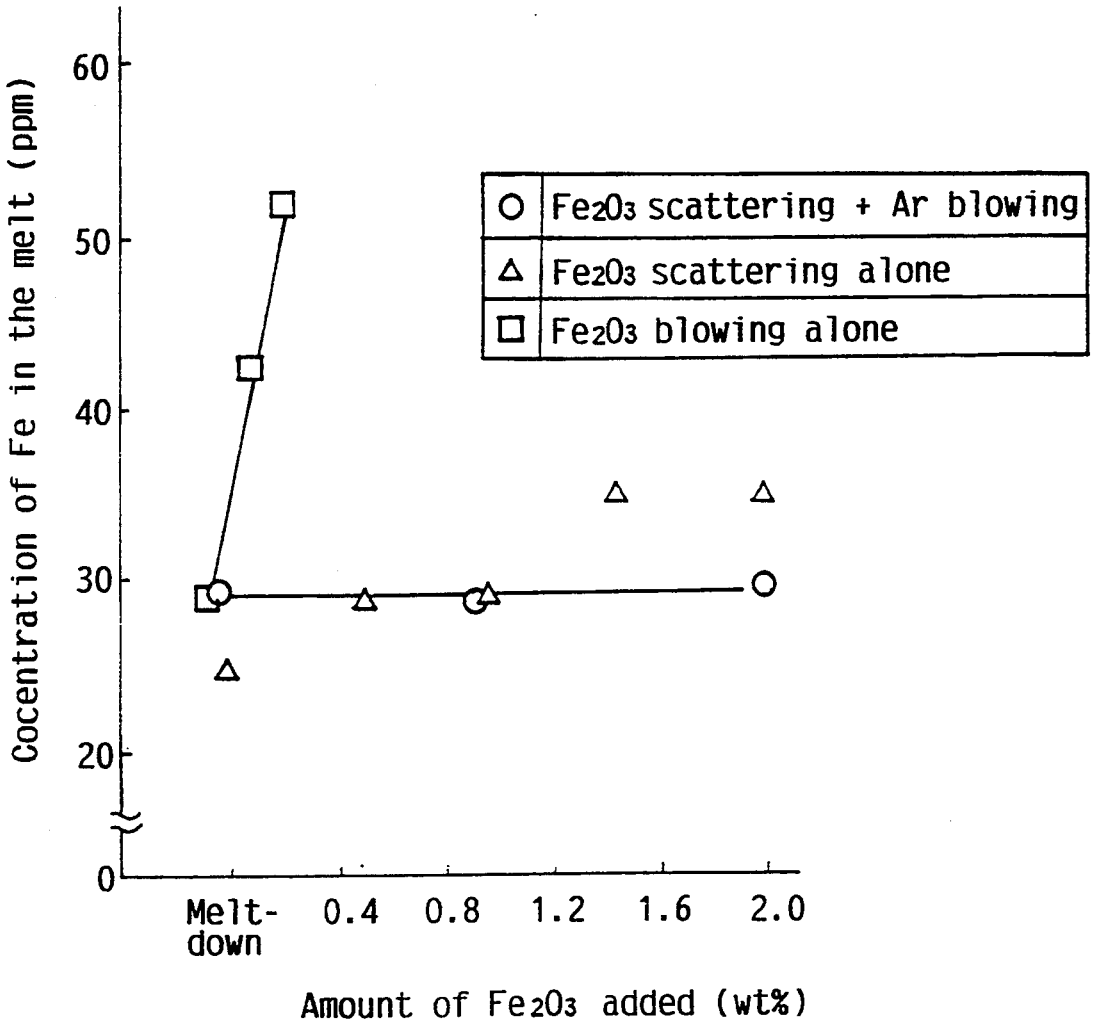
FIG. 8 is a graph showing how the way of adding Fe oxide in the step (2) or (2b) affects the Fe concentration in the melt.

How the amount of $Fe_2O_3$ added to the melt affects the Fe concentration in the melt depending on the way of adding $Fe_2O_3$ to the melt was investigated. The results are shown in FIG. 8. It is noted that the blowing of $Fe_2O_3$ into the melt markedly increases the Fe concentration in the melt, making an adverse effect on refining. By contrast, the scattering of $Fe_2O_3$ on the surface of the melt hardly increases the Fe concentration in the melt regardless of its amount added.

The effect of the duration of treatment on the concentrations of Ni and Pb in the melt was investigated using a melt of copper alloy containing 100 ppm each of Pb and Ni, with $Fe_2O_3$ added by mere scattering or by scattering and Ar bubbling in combination (at 1200° C.).

Figure 9:
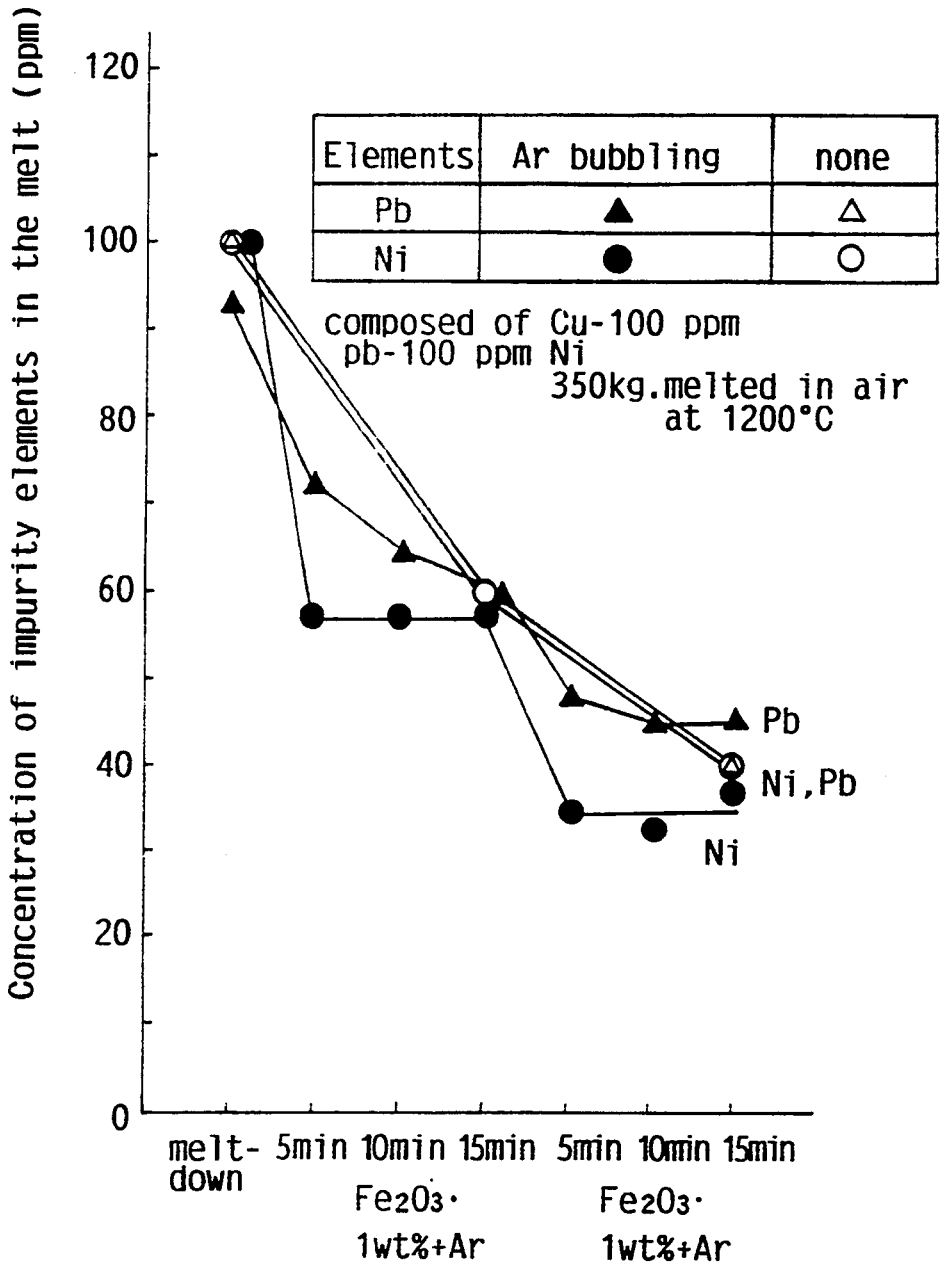
FIG. 9 is a graph showing how the blowing of Ar in the step (2) or (2b) affects the removal of impurity metals.

The results are shown in FIG. 9. It is noted that Ar blowing hardly produces the effect of melt stirring and the mere scattering of $Fe_2O_3$ is enough to sufficiently remove Ni and Pb from the melt.

Figure 10:
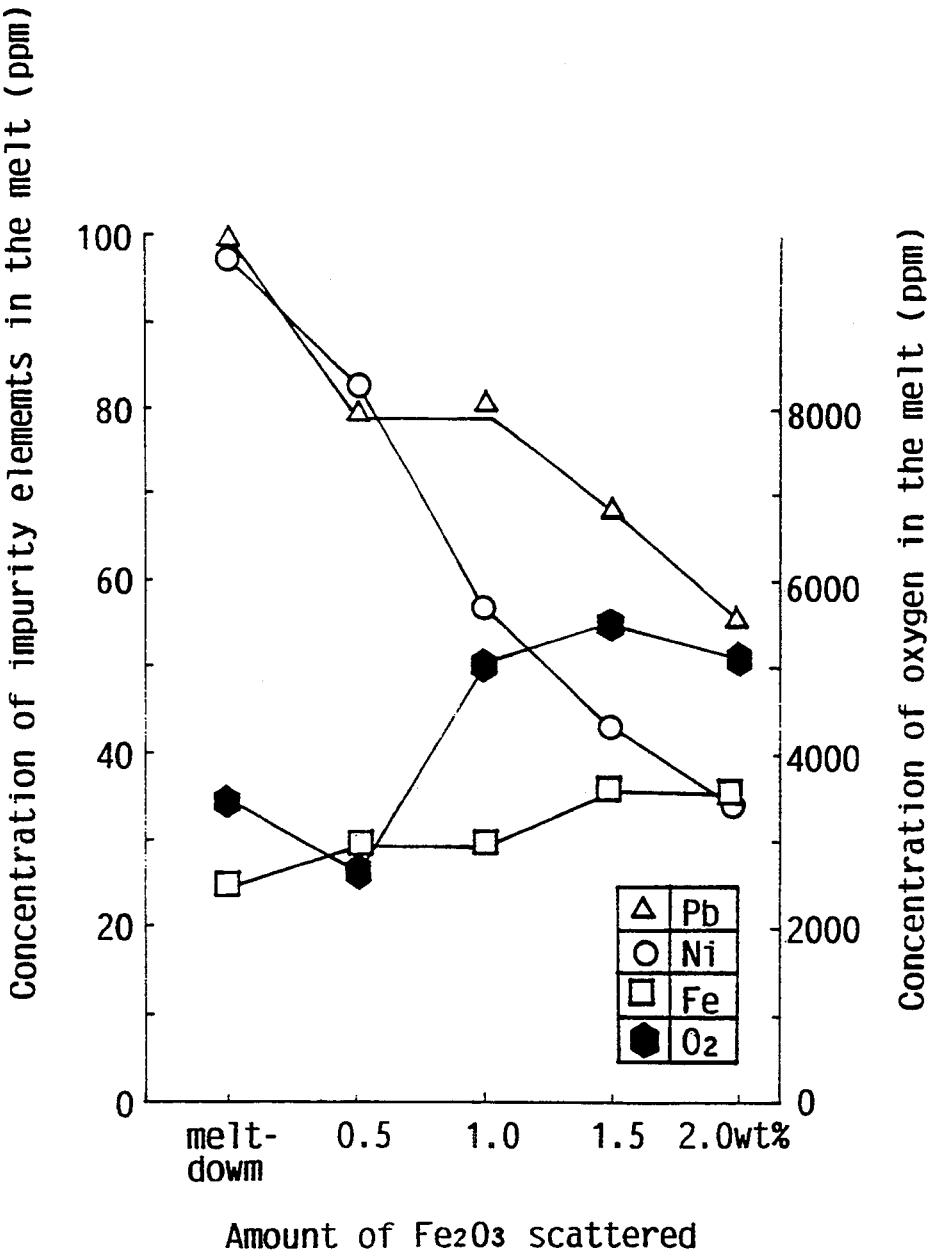
FIG. 10 is a graph showing how the varied amount of Fe oxide scattered in the step (2) or (2b) affects the removal of impurity metals.

The effect of the amount of $Fe_2O_3$ scattered on the concentrations of Ni, Pb, Fe, and oxygen in the melt (3 minutes after treatment at 1200° C. under the atmosphere) was investigated using a melt of crude material for copper containing 100 ppm each of Ni and Pb. The results are shown in FIG. 10. It is noted that the scattering of $Fe_2O_3$greatly decreases the concentrations of Ni and Pb without increase in Fe concentration in the melt.

Figure 11:
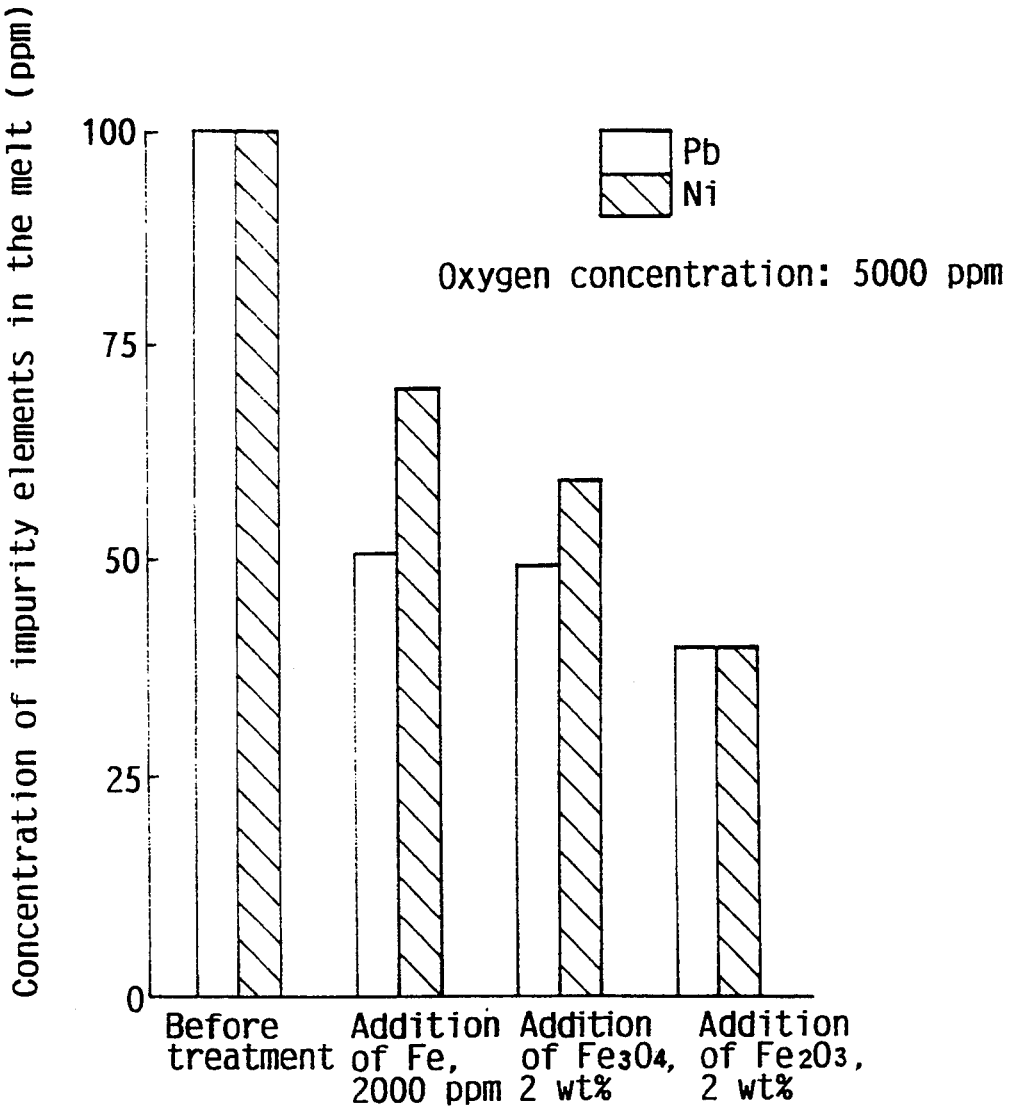
FIG. 11 is a graph showing how the way of adding Fe in the step (2) or (2b) affects the removal of Pb and Ni.

The effect of Fe (2000 ppm), $Fe_2O_3$ (2 wt. %), or $Fe_3O_4$ (2 wt. %) scattered over the melt on the removal of Ni and Pb from the melt (3 minutes after treatment under the atmosphere) was investigated using a melt of crude material for copper containing 100 ppm each of Ni and Pb. The results are shown in FIG. 11. It is noted that $Fe_2O_3$ is most effective but $Fe_3O_4$ and Fe are also considerably effective in the removal of Ni (or Pb).

Almost the same effect of removing Ni (or Pb) by the use of Fe oxides as demonstrated in FIGS. 4 to 11 above is produced even when Fe oxides are replaced by Mn oxides. This is the case in the removal of Sb, S, Bi, or As from a melt of crude material for copper.

Figure 12:
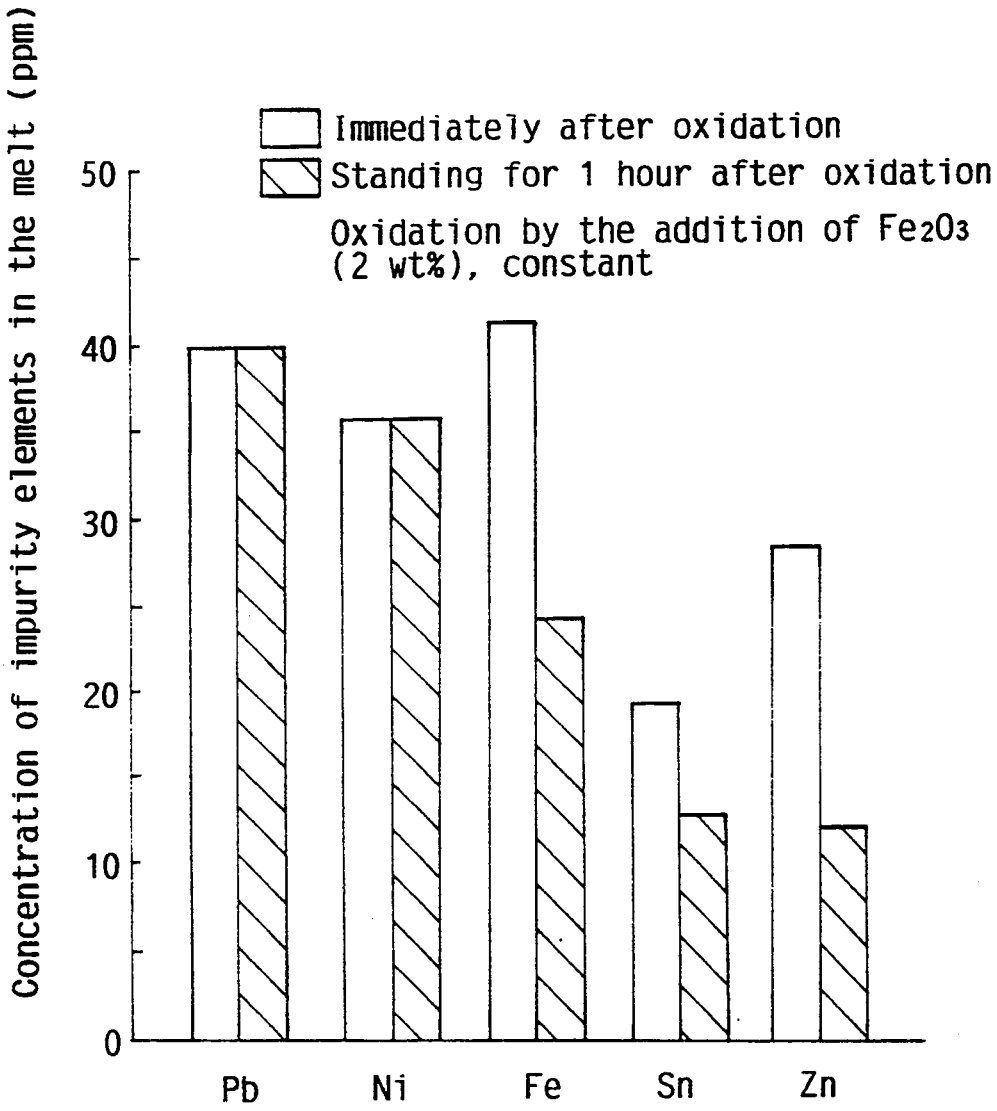
FIG. 12 is a graph showing how the concentration of impurity metals in the melt varies depending on whether or not the melt is allowed to stand after the formation of compound oxide in the step (2) or (2b).

Meanwhile, the removal of impurity metals in the form fine particulate oxides or compound oxides from the melt is effectively accomplished if the treated melt is allowed to stand until they float on the melt, as explained above with reference to FIG. 2. This was confirmed by experiments with a melt of crude material for copper containing 100 ppm each of Fe, Sn, Zn, Ni, and Pb. The melt under-went the step (2a) of air bubbling to raise the oxygen concentration to 10000 ppm. With the resulting oxide unremoved, the melt underwent the step (2b) of scattering with $Fe_2O_3$ (in an amount of 2 wt. % of the melt). The concentrations of impurity metals were determined immediately after the stirring by induction heating for 15 minutes, which followed the step (2b). Alternatively, the concentrations of impurity metals were determined after the stirring by induction heating for 15 minutes and subsequent standing for 1 hour, which followed the step (2b). The results are shown in FIG. 12. It is noted that allowing the melt to stand for a while after the consecutive steps (2a) and (2b) is effective in greatly reducing the content of Fe, Zn, and Zn in the melt because the fine particulate oxides of Fe, Sn, and Zn formed by the step (2a) for oxidation float on the surface of the melt although part of them dispersing in the melt is brought to the step (3). However, it hardly affects the concentrations of Pb and Ni. Presumably, this is because double oxides of Pb and Ni rapidly float on the surface of the melt.

The amount of Fe and Mn and oxides thereof to be added in the step (2b) should preferably be 10–50,000 ppm of the melt. The step (2b) may be carried out once if the amount of impurity metals to be removed is small; otherwise, it should be repeated several times. In the latter case, the above-mentioned amount should be added each time of repetition.

Figure 13:
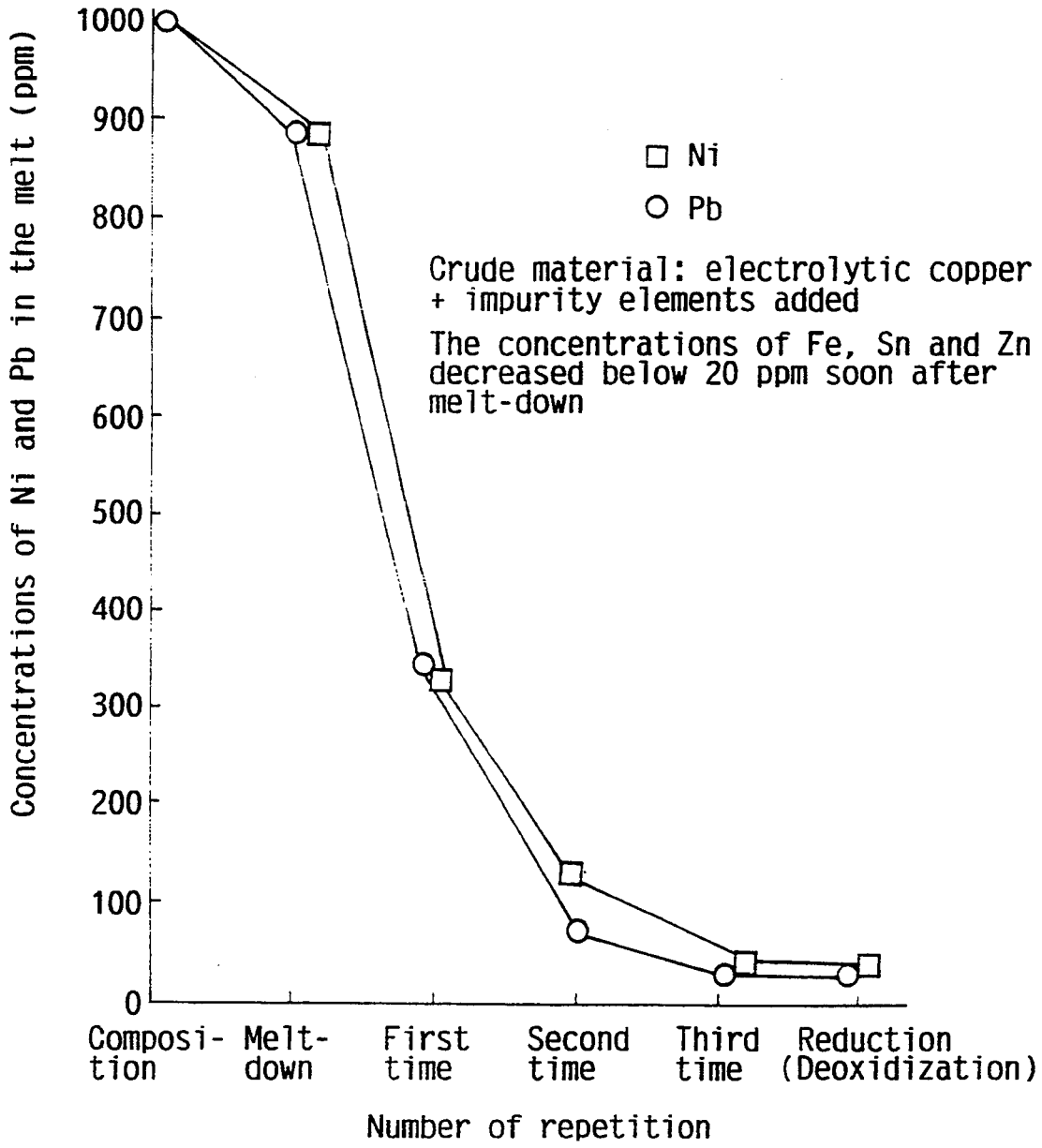
FIG. 13 is a graph showing the relationship between the number of repetitions of the formation of compound oxide in the step (2) or (2b) and the amount of impurity metals in the melt.

The effect of repeating the step (2b) on decrease in Ni and Pb concentrations was investigated using a copper melt containing 1000 ppm each of Ni and Pb. The results are shown in FIG. 13. It is noted that the amount of impurity elements decreases with the increasing number of repetition.

Incidentally, the step (a) or (2b) should be carried out with the melt kept at 1200°–1230° C., preferably 1100°–1200° C., so that it gives rise to slag in the form of sticky solid or semi-solid. Such slag catches well oxides and compound oxides floating on the surface of the melt.

STEP 3

This step is designed to remove the slag which floats on the surface of the melt as the result of the step (2) or (2b). The removal of slag may be carried out in the usual way. The following procedure is recommended for efficient slag removal and high copper yields.

Figure 14:
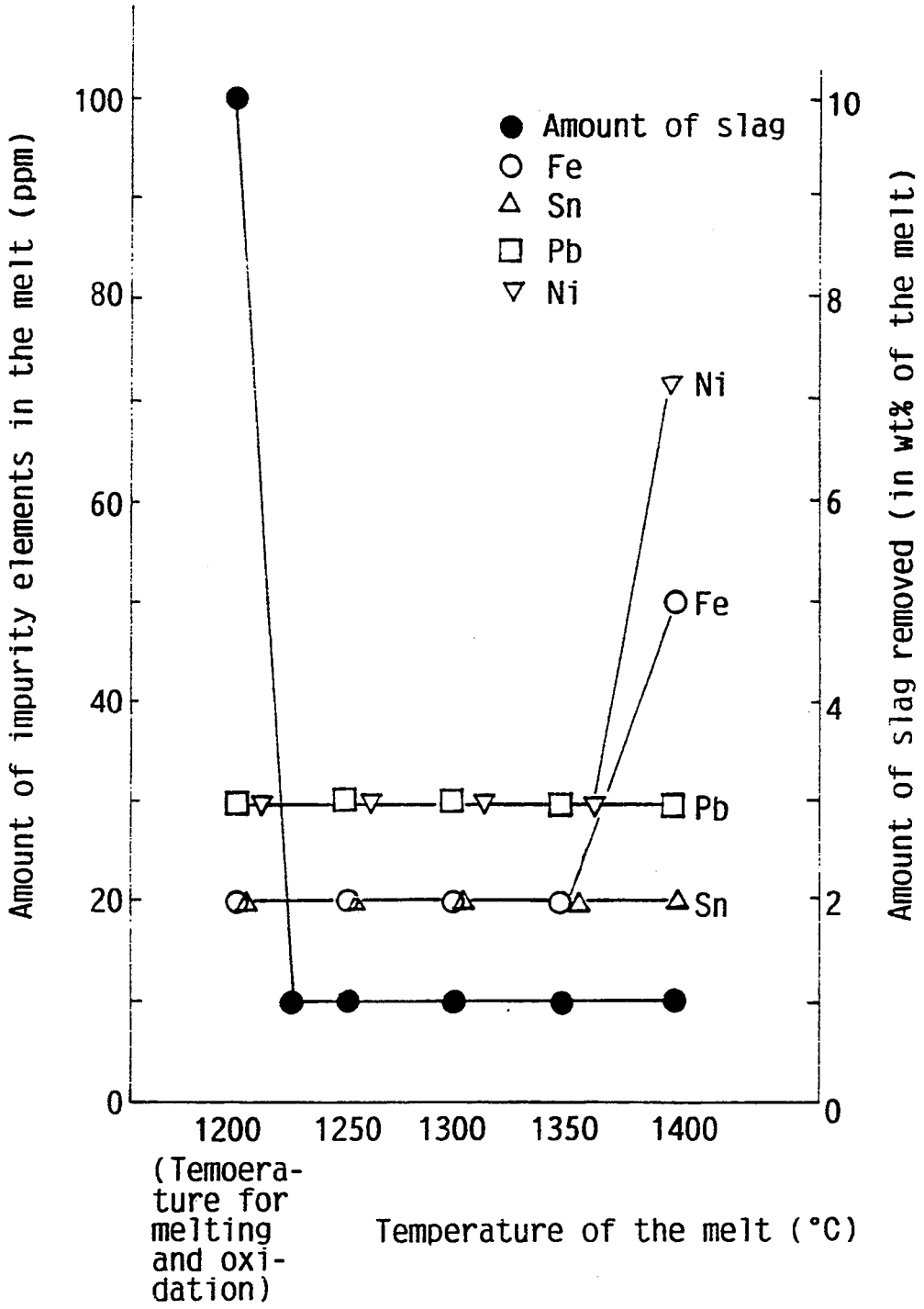
FIG. 14 is a graph showing the relationship between the melt temperature at the time of slagging in the step (3) and the concentration of impurity metals.

Upon completion of the step (2) or (2b), slag floats on the surface of the melt. It contains oxides of impurity elements and double oxides of Fe and Mn (as mentioned above) as well as a large amount of copper oxides (especially $Cu_2O$) formed in the oxidation step, the former dispersing in the latter. Therefore, the mere removal of slag will lead to a nonnegligible loss of copper. This may be avoided by heating the melt to 1225°–1400° C. before the removal of slag, so that part of copper oxides returns to the melt. The effect of heating was experimentally proved by melting a copper alloy containing 100 ppm each of Fe, Sn, Ni, and Pb under the atmosphere, blowing air into the melt to raise the oxygen content to 10000 ppm in the step (2a), scattering $Fe_2O_3$ (in an amount of 2 wt. % of the melt) over the surface of the melt and stirring the melt by induction heating in the step (2b), and raising the melt temperature to 1200°–1400° C. before the removal of slag. The melt temperature is related to the amount of slag removed (in terms of ratio to the amount of slag removed when the melt temperature is 1200° C.) and the concentrations of impurity elements in the melt as shown in FIG. 14. It is noted that the amount of slag removed is reduced to about one-tenth if the melt temperature is higher than 1225° C. when slag is removed. The smaller the amount of slag removed, the smaller the amount of copper oxide discharged together with oxides of impurity metals. If the melt temperature is lower than 1400° C., more specifically lower than 1370° C., there is no possibility that impurity elements return to the melt. The melt temperature should preferably be in the range of 1230°–1370° C.; at 1400° C. or above Ni and Fe are liable to return to the melt.

Figure 15:
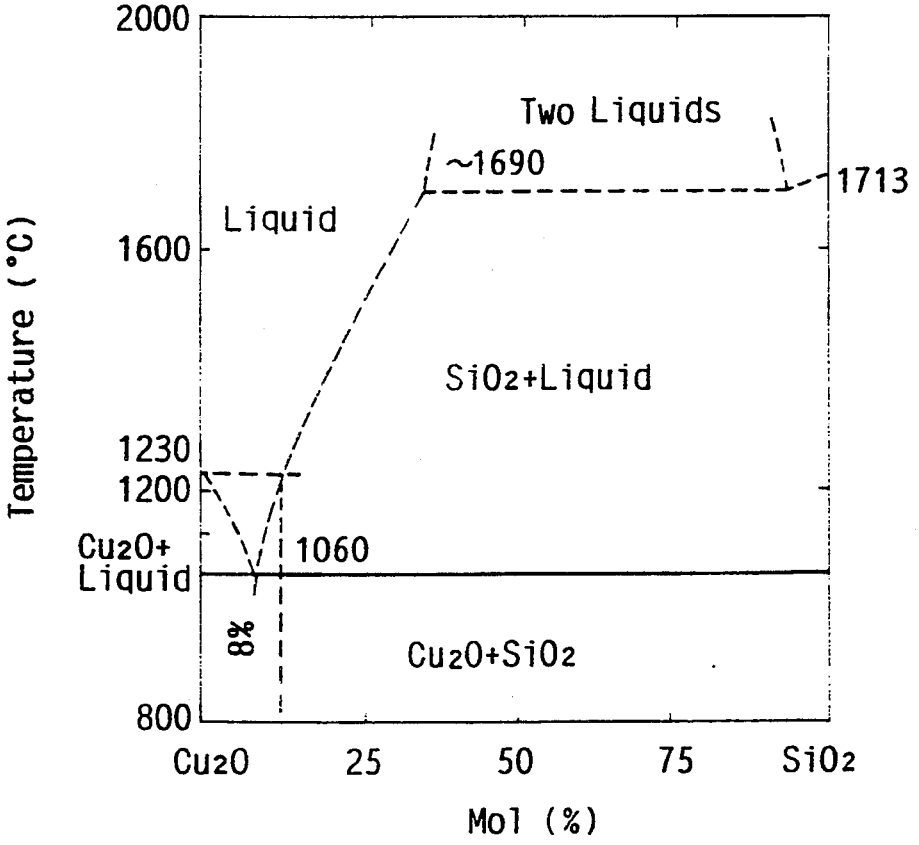
FIG. 15 is a phase diagram for $Cu_2O$ and $SiO_2$.

For the efficient slag removal, it is desirable to scatter an $SiO_2$—$Al_2O_3$ flux over the surface of the melt so that it combines with slag floating on the surface of the melt. This flux does not wet the copper melt but wets well the slag floating on the surface of the melt. The constituents ($SiO_2$ and $Al_2O_3$) of the flux function as follows. $SiO_2$ does not wet the copper melt but wets well and combines with slag floating on the surface of the melt. It reacts with $Cu_2O$ (as the principal component of slag) as shown in FIG. 15 (phase diagram). It is noted that having a melting point of 1230° C., $Cu_2O$ remains in the half-molten state in the temperature range of 1100°–1200° C. at which the crude material for copper is melted. On the other hand, having a melting point of about 1700° C., $SiO_2$ remains in the solid state at temperatures at which copper is melted. The $Cu_2O$—$SiO_2$ system has a eutectic point when the $SiO_2$ content is 8%. As the $SiO_2$ content exceeds 8%, the following reaction takes place, with solid $SiO_2$ and liquid $Cu_2O$ coexisting.

$$Cu_2O + SiO_2 \rightarrow SiO_2\ (\text{solid}) + Cu_2O\ (\text{liquid})$$

In practical operation, however, the temperature of floating slag is slightly lower than that of the melt because the surface of the melt is exposed to the atmosphere. This situation favors the reaction between half-molten $Cu_2O$ and solid $SiO_2$ and the removal of slag from the surface of the melt, because $SiO_2$ wets well $Cu_2O$ but does not wet the copper melt.

Figure 16:
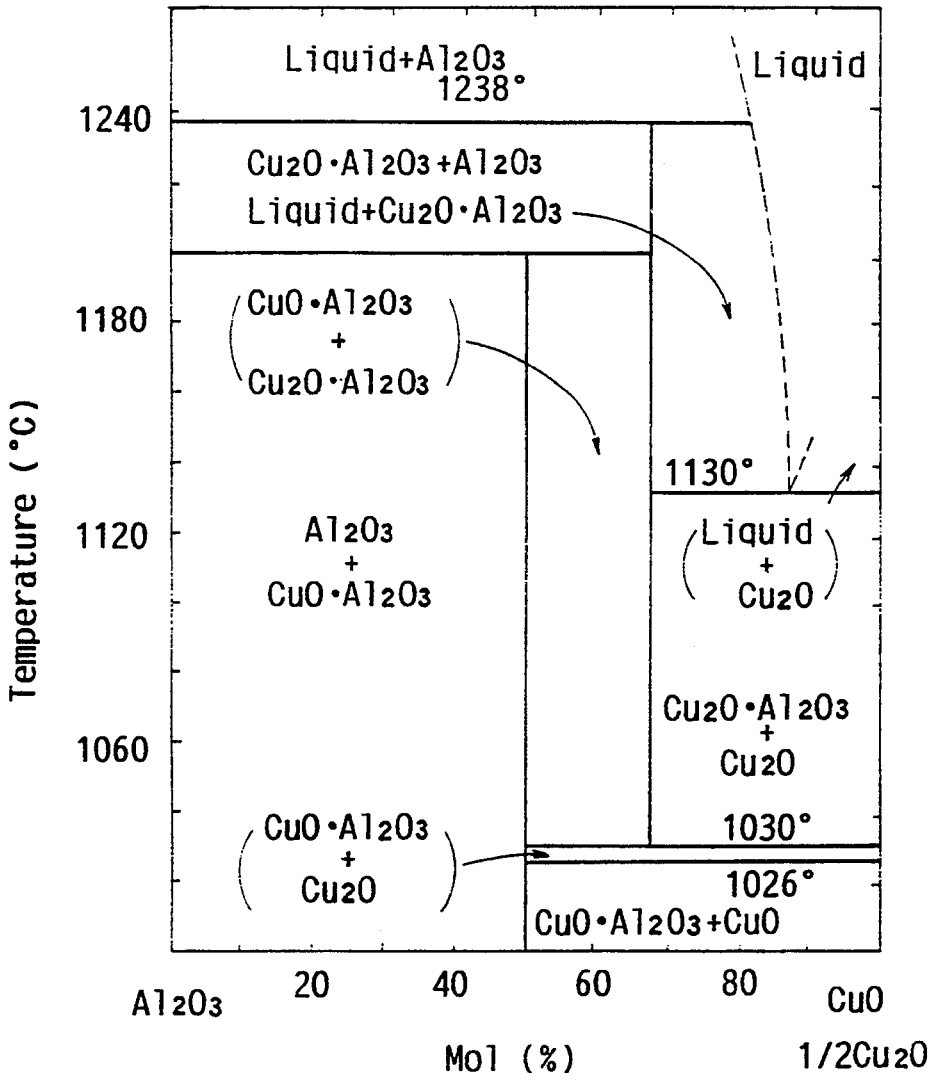
FIG. 16 is a phase diagram for CuO (and $Cu_2O$) and $Al_2O_3$.

Unfortunately, the scattering of $SiO_2$ over the surface of the copper melt greatly raises the melting point of [$SiO_2+Cu_2O$ (liquid)], giving rise to platy hard slag floating on the surface of the melt. Such slag is hard to remove once it sticks to the furnace wall. To avoid this situation, it is desirable to use an additional component. It turned out that $Al_2O_3$ produces its effect when it is scattered over the surface of the melt. As FIG. 16 (phase diagram) shows, $Cu_2O$ and $Al_2O_3$ react with each other at about 1200° C. to form a stabler compound $Cu_2O$—$Al_2O_3$ which is easy to break. Moreover, $Al_2O_3$ remaining solid adsorbs slag but separates easily from the copper melt. This greatly contributes to the easy and efficient removal of slag. Thus the $SiO_2$—$Al_2O_3$ flux permits slag to be removed very easily from the surface of the melt because of its ability to adsorb slag and to form compound oxides which break easily but does not wet the copper melt. The $SiO_2$—$Al_2O_3$ flux should preferably be composed of 70–90% $SiO_2$ and 10–30% $Al_2O_3$ on the basis of experimental data shown Table 1 below.

TABLE 1

| | $SiO_2$ (%) | $Al_2O_3$ (%) | Slagging | Rating |
|---|---|---|---|---|
| Comparative | 10 | 90 | Difficult to remove due to high viscosity and high resistance to break | Poor |
| | 20 | 80 | | |
| | 30 | 70 | | |
| | 40 | 60 | Difficult to remove due to high viscosity | Poor |
| | 50 | 50 | | |
| | 60 | 40 | | |
| Normal | 70 | 30 | Easy to remove due to adequate viscosity and resistance to break | Good |
| | 80 | 20 | | |
| | 90 | 10 | | |
| Comparative | 100 | 0 | Difficult to remove due to high viscosity | Poor |

Amount of flux added to the melt: 0.2 wt % of the melt

The amount of the flux should be in the range of 0.005–0.10 wt. % of the melt according to the experimental data shown in Table 2 below.

TABLE 2

| | Flux added (%) | Slagging | Rating |
|---|---|---|---|
| Comparative | 0 | Comparative condition | Poor |
| Normal | 0.005 | Easy to remove (Amount of slag removed is 50 wt % less than that without flux) | Good |
| | 0.010 | | |
| | 0.020 | | |
| | 0.030 | | |
| | 0.050 | | |
| | 0.10 | | |
| Comparative | 0.20 | Difficult to remove due to excessive flux volume for slag | Poor |
| | 0.40 | | |
| | 1.00 | | |

Flux: $SiO_2$—$Al_2O_3$ = 80/20 %
Amount of flux: wt % of the melt (at 1210° C.)

Incidentally, the flux may be prepared not only from pure $SiO_2$ and $Al_2O_3$ in a prescribed ratio but also from natural minerals containing them such as $CaAl_2SiO_2$ (anorthite), $NaAlSi_3O_8$ (albite), and $KAl_2(Si_3Al)O_{10}(OH{\cdot}F)_2$ (muscorite). The effect of adding the $SiO_2$—$Al_2O_3$ flux was confirmed by experiments given below. It is understood that improved slagging is possible with a minimum of copper loss if the $SiO_2$—$Al_2O_3$ flux of adequate composition is added in a proper amount.

EXPERIMENT EXAMPLE 1

Crude material: electrolytic copper (80%) and commercial scrap copper (20%)
Melting condition:
Melting furnace: 5-ton oil-fired reverberatory furnace
Melting temperature: 1200±20° C.
Melting atmosphere: air
Oxygen concentration in the melt: 50000 ppm
Slagging condition:
Flux: $SiO_2$ 70%, $Al_2O_3$ 30% $SiO_2$ 90%, $Al_2O_3$ 10%
Amount of flux added: 0.1 wt. % of the melt (fluxing followed by stirring)

Table 3 below shows the copper loss due to slagging and the slagging performance.

TABLE 3

| Flux (wt %) | Copper loss (wt %) due to slagging | Slagging performance | Rating |
|---|---|---|---|
| $Al_2O_3$ (30) $SiO_2$ (70) | 4 | good | good |
| $Al_2O_3$ (10) $SiO_2$ (90) | 4 | good | good |
| without flux | 10 | poor | poor |

EXPERIMENT EXAMPLE 2

Crude material: commercial scrap copper (100%)
Melting condition:
Melting furnace: 3-ton channel--type induction furnace
Melting temperature: 1200±15° C.
Melting atmosphere: air
Oxygen concentration in the melt: 10000 ppm
Slagging condition:
Flux: $SiO_2$ 70%, $Al_2O$ 3 30% $SiO_2$ 90%, $Al_2O_3$ 10%
Amount of flux added: 0,005 wt. % of the melt (fluxing followed by stirring)
Table 4 below shows the results of the experiment.

TABLE 4

| Flux (wt %) | Copper loss (wt %) due to slagging | Slagging performance | Rating |
|---|---|---|---|
| $Al_2O_3$ (30) $SiO_2$ (70) | 4 | good | good |
| $Al_2O_3$ (10) $SiO_2$ (90) | 3 | good | good |
| without flux | 8 | poor | poor |

It is noted from Tables 3 and 4 that the addition of the $SiO_2$—$Al_2O_3$ flux of adequate composition in an adequate amount improves the slagging performance and greatly decreases the copper loss at the time of slagging.

STEP (4) FOR REDUCTION

The copper melt which has undergone the step (3) for slagging contains a large amount of oxygen (usually higher than 1000 ppm) resulting from the blowing of oxygen (or air) or the addition of oxide for the removal of impurity elements by oxidation in the step (2) or the steps (2a) and (2b). Thus, it is necessary to remove oxygen from the melt by this step (4).

The oxygen concentration in copper alloy should be lower than 200 ppm. This object is achieved by reduction in the usual way or by a special method which is by adding a reducing agent to the surface of the melt and blowing an inert gas into the melt or toward the surface of the melt.

The addition of a reducing agent to the surface of the melt brings about a reduction reaction which evolves $CO_2$ and CO. These gases partly dissipate and partly dissolve in the melt. The latter part of the gases, along with oxygen present in the melt, diffuse into the bubbles of the inert gas blown into the melt due to difference in partial pressure. Finally they escape from the melt. The thus released oxygen does not dissolve again in the melt if the inert gas is blown toward the surface of the melt. This permits the efficient reduction or the removal of oxygen from the melt. The reducing agent may be in the form of powdery solid (e.g., charcoal) or gas (e.g., hydrogen and carbon monoxide), with the former being preferable.

After reduction by the conventional method, the melt contains oxygen in the form of oxide ($Cu_2O$) or dissolved oxygen. Charcoal (as a reducing agent) added to the melt reacts with oxide or dissolved oxygen as follows.

$$C+Cu_2O \rightarrow 2Cu+CO\uparrow$$

$$2C+O_2 \rightarrow 2CO\uparrow$$

In other words, $Cu_2O$ and $O_2$ in the melt are reduced by carbon into CO which escapes from the melt. However, this is not the case for the melt which has undergone the steps (1) to (3) according to the present invention. It turned out that the melt before reduction contains oxygen in the form of oxide (CuO, $Cu_2O$, etc.) alone, but not in the form of dissolved oxygen, as indicated by the results of analysis by the partial pressure equilibrium method (Japanese Patent Laid-open No.272380/1987 (Patent Publication No.113625/1989)). This suggests that the reduction reaction proceeds as follows.

$$2Cu_2O+C \rightarrow 4Cu+O_2\uparrow+C$$

$$C+O_2 \rightarrow CO_2\uparrow$$

In other words, it is considered that charcoal (as a reducing agent) scattered over the surface of the melt reacts with CuO or $Cu_2O$ in the melt to give $O_2$ and it further reacts with $O_2$ to give $CO_2$ which remains in the melt. It was found by gas analysis, contrary to the popular view, that the melt contains very little CO but contains some $O_2$ and $CO_2$. This is true of the surface of the melt.

The foregoing suggests that the reduction of the copper melt is not satisfactory as expected because $O_2$ evolved by reduction remains in the melt or immediately above the surface of the melt as if it covers the melt and prevents the escape of $O_2$-containing gas.

Figure 17:
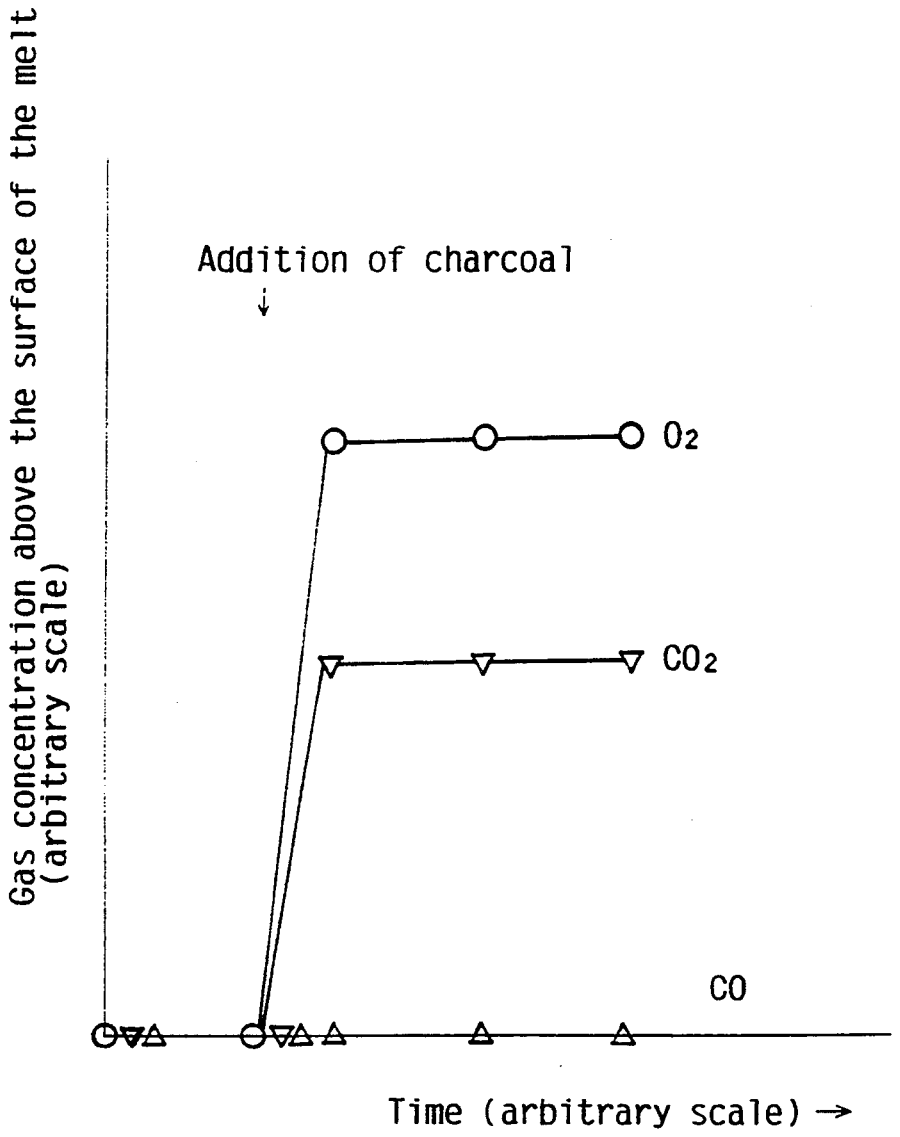
FIG. 17 is a graph showing the relationship between the length of time for reduction in the step (4) and the gas concentration above the surface of the melt.
Figure 18:
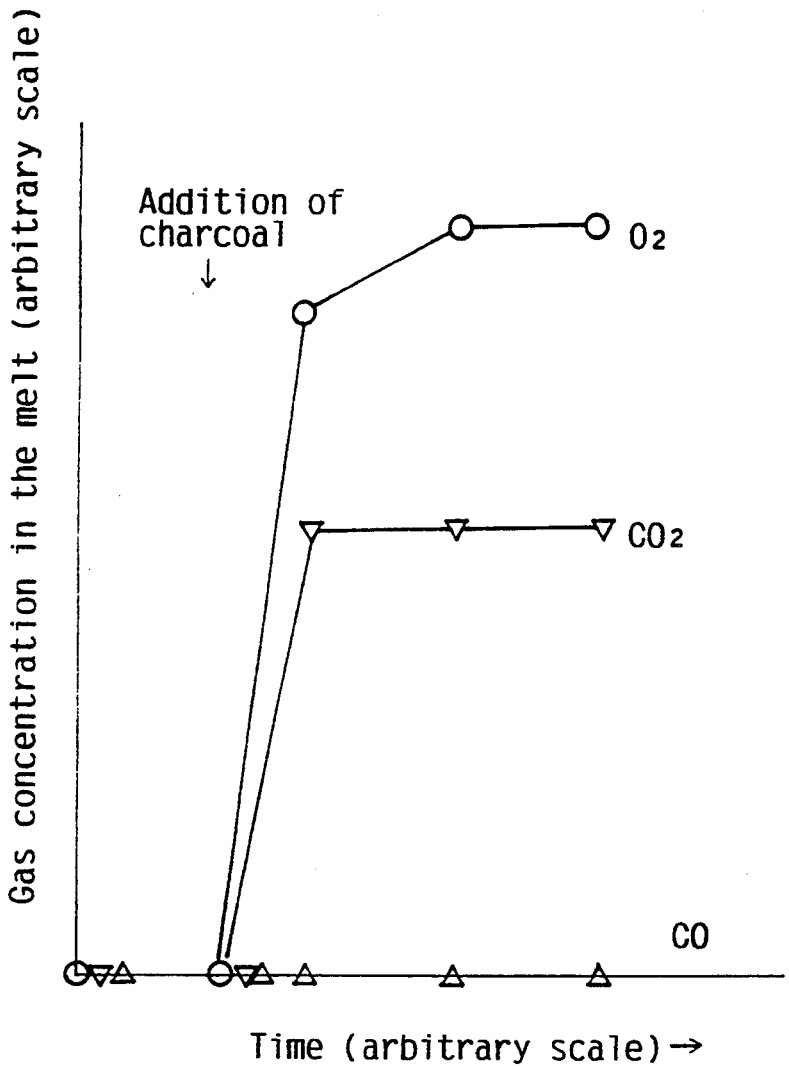
FIG. 18 is a graph showing the relationship between the length of time for reduction in the step (4) and the gas concentration above the surface of the melt.
Figure 19:
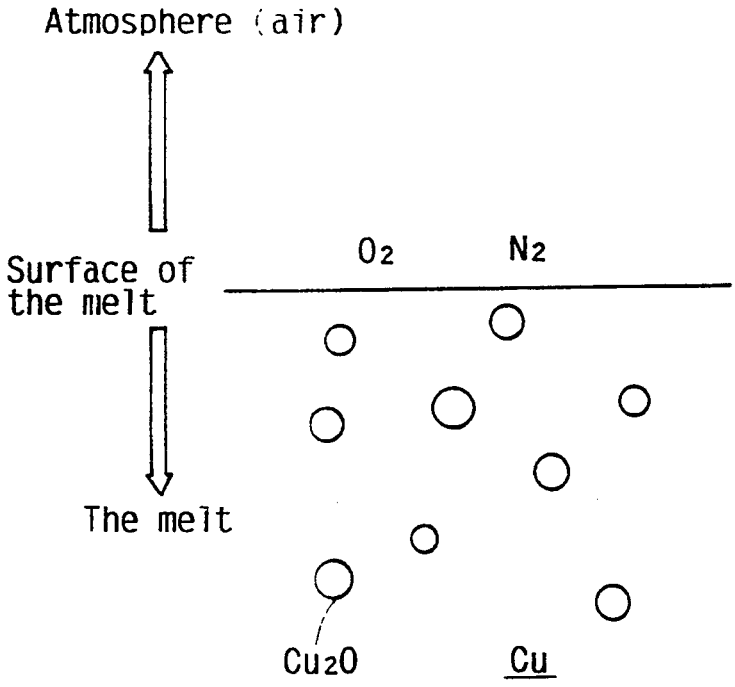
FIG. 19 is a schematic representation showing the state of the interface of the melt which exists before reduction by the step (4).
Figure 20:
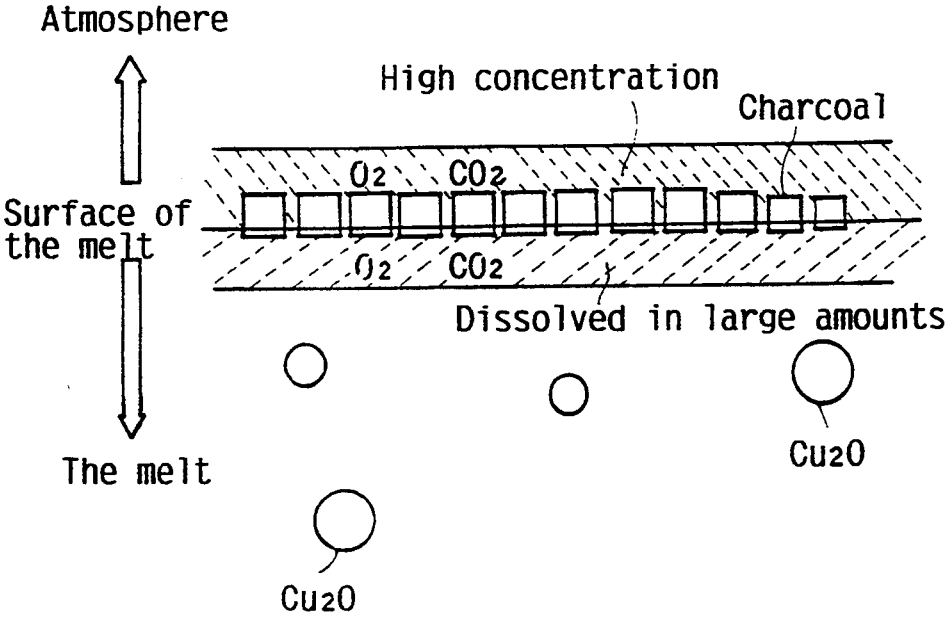
FIG. 20 is a schematic representation showing the state of the interface of the melt which exists at the time of reduction by the step (4).

The above-mentioned reasoning is explained below with reference to FIGS. 17 to 20. FIG. 17 shows how the gas concentration (measured by gas chromatography) immediately above the surface of the melt changes with time. It is noted that $O_2$ and $CO_2$ are evolved immediately after the addition of charcoal (C) to the surface of the melt and the amount of their evolution remains almost unchanged with time. By contrast, it is also noted that CO is not evolved both immediately after and long after the addition of charcoal. FIG. 18 shows how the gas concentration in the melt (measured by the partial pressure equilibrium method) changes with time. It is noted that $O_2$ and $CO_2$ are evolved immediately after the addition of charcoal (C) to the melt and their concentrations remain almost unchanged with time. By contrast, it is also noted that CO is not evolved both immediately after and long after the addition of charcoal. FIG. 19 schematically shows what is happening in the vicinity of the surface of the melt before the scattering of charcoal (C) over the surface of the melt. It is noted that there exist $O_2$ and $N_2$ above the surface of the melt and there exists a large amount of oxides ($Cu_2O$ etc.) in the melt. FIG. 20 schematically shows what happens in the vicinity of the surface of the melt immediately after the scattering of charcoal over the surface of the melt. It is noted that $O_2$ and $CO_2$ are present in high concentration in the atmosphere close to the surface of the melt and $O_2$ and $CO_2$ are also dissolved in high concentration in the melt close to its surface. It is considered that there is a less amount of oxide ($Cu_2O$ etc.) in the melt.

For reasons mentioned above, it is necessary that the reduction of the copper melt by the step (4) should be carried out such that $O_2$ and $CO_2$ evolved by reduction are released rapidly from the melt and from above the surface of the melt. This object is accomplished by blowing an inert gas into the melt and/or toward the surface of the melt, thereby removing $O_2$ and $CO_2$ covering the surface of the melt and causing the inert gas to catch $O_2$ in the melt due to difference in their partial pressure and releasing $O_2$ together with the inert gas from the system. The effect of the inert gas blown into the melt or blown toward the surface of the melt is explained below with reference to experiment examples.

Figure 21:
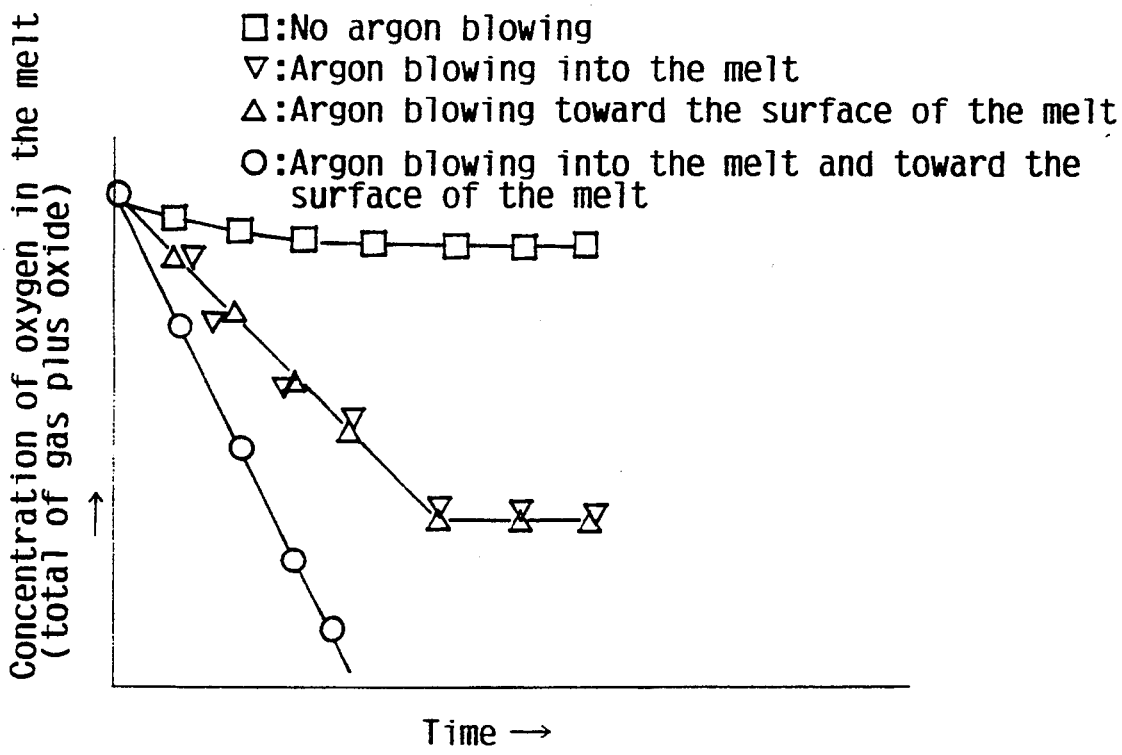
FIG. 21 is a graph showing how the blowing of Ar or the duration of the blowing of Ar in the step (4) for reduction affects the oxygen concentration in the melt.

The experiment was carried out with electrolytic copper (100%) melted at 1200±20° C. in a 1-ton melting furnace. Charcoal in an amount of 1 wt. % of the copper melt was scattered over the surface of the melt, and then argon was blown into the melt or toward the surface of the melt through a lance (3 mm in diameter) at a flow rate of 30N l/min. How the oxygen concentration ($O_2$+oxide) in the melt changes with time was recorded. The results are shown in FIG. 21. It is noted that without argon blowing the oxygen concentration changes very little with time. By contrast, with argon blowing into the melt or toward the surface of the melt the oxygen concentration rapidly decreases with time. With argon blowing both into the melt and toward the surface of the melt, the oxygen concentration much more rapidly decreases with time.

Figure 22:
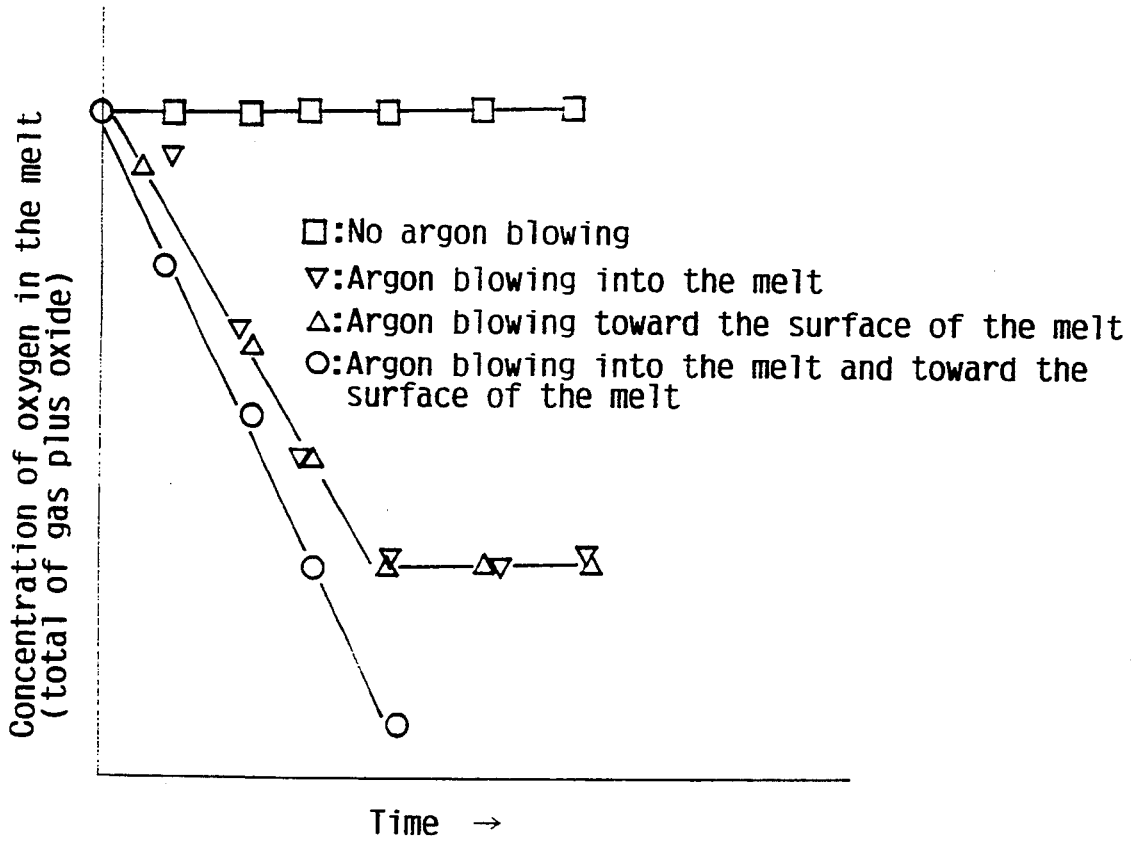
FIG. 22 is a graph showing how the blowing of Ar or the duration of the blowing of Ar in the step (4) for reduction affects the oxygen concentration in the melt.

The experiment was also carried out with scrap of Cu-Fe alloy, KLF-194, (100%) melted at 1200±20° C. in a 1-ton melting furnace. Charcoal in an amount of 1 wt. % of the copper melt was scattered over the surface of the melt, and then argon was blown into the melt or toward the surface of the melt through a lance (3 mm in diameter) at a flow rate of 30N l/min. How the oxygen concentration ($O_2$+oxide) in the melt changes with time was recorded. The results are shown in FIG. 22. It is noted that without argon blowing the oxygen concentration changes very little with time. By contrast, with argon blowing into the melt or toward the surface of the melt, the oxygen concentration rapidly decreases with time. With argon blowing both into the melt and toward the surface of the melt the oxygen concentration much more rapidly decreases with time.

As mentioned above, it is possible to greatly reduce the oxygen concentration in the melt within a short time if a reducing agent is added to the melt and an inert gas is blown into the melt and/or toward the surface of the melt in the step (4). To make sure the effect of reduction, an experiment was carried out as follows. The results are shown in FIG. 23.

Conditions of experiment
Amount of copper melt: 250 kg
Melting temperature: 1250° C.
Amount of charcoal: 5 kg
Inert gas (argon): 10–13 l/min (by bubbling)
The oxygen concentration in the melt was controlled by the melting under the atmosphere and the addition of CuO.

Figure 23:
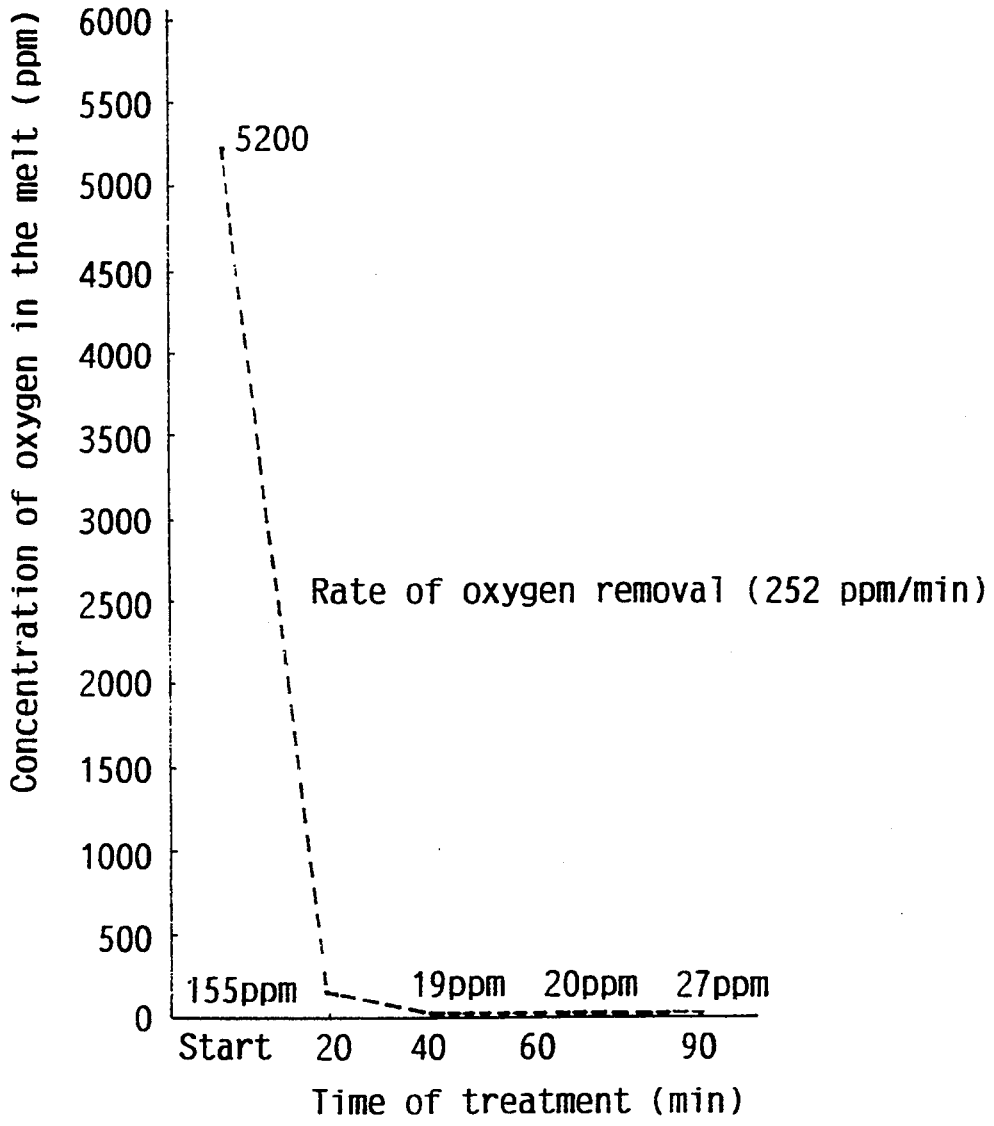
FIG. 23 is a graph showing the relationship between the length of time for reduction in the step (4) and the amount of oxygen in the melt.

It is noted from FIG. 23 that the oxygen concentration in the melt rapidly decreases with time. That is, it decreases from 5200 ppm to 155 ppm (at a rate of 252 ppm/min) as the result of reduction for 20 minutes and to 19 ppm after 40 minutes. It slightly increases to 20 ppm after 60 minutes and 27 ppm after 90 minutes. In actual operation, it is desirable to stop reduction when the oxygen concentration reaches the minimum.

Figure 24:
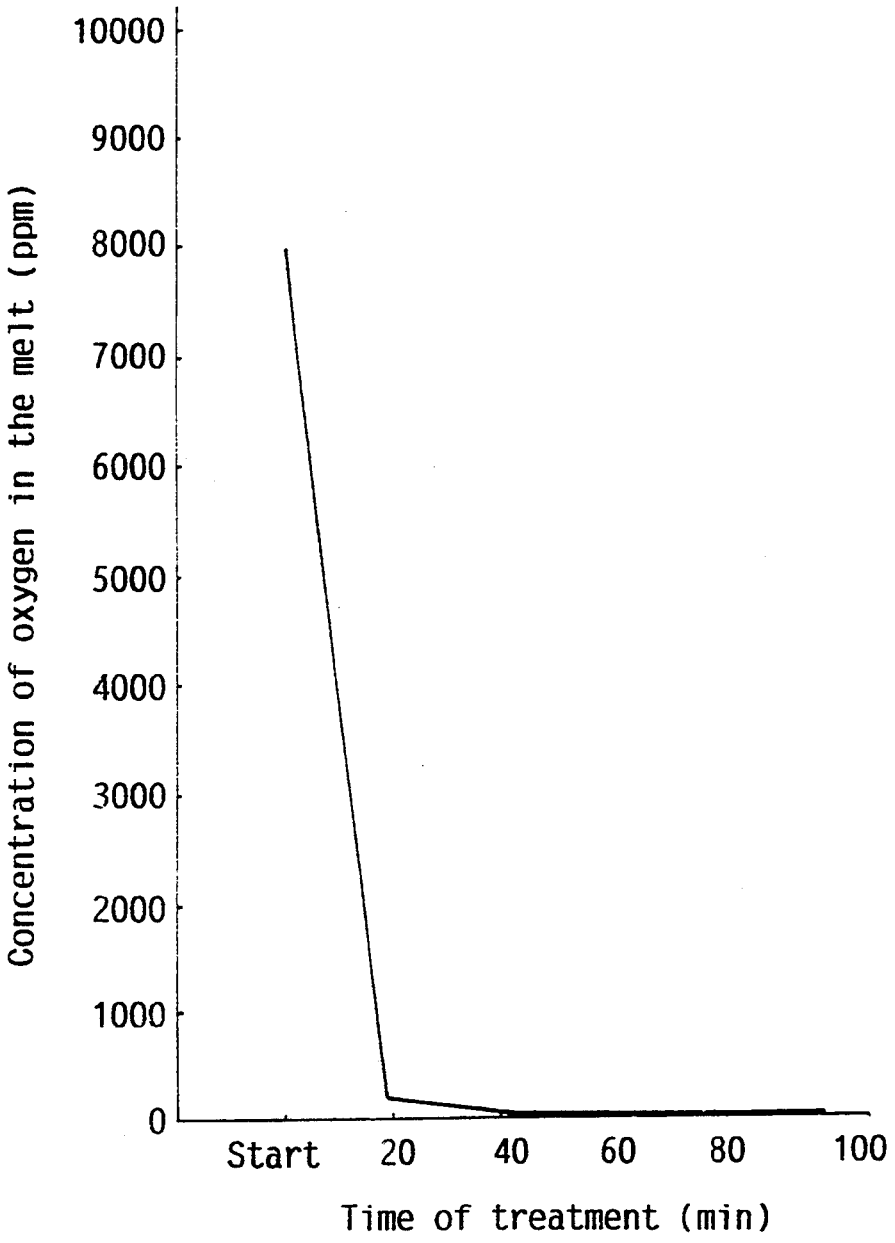
FIG. 24 is a graph showing the relationship between the length of time for reduction in the step (4) and the amount of oxygen in the melt.

A similar experiment as above was carried out which produced the results as shown in FIG. 24. It is noted that the oxygen concentration decreases from 8000 ppm to 250 ppm within 20 minutes and approaches nearly zero after 40 minutes.

To further illustrate the invention, and not by way of limitation, the following examples are given. Their variations may be made by one skilled in the art without departing from the spirit and scope of the invention.

EXAMPLE 1

Crude material: commercial scrap copper (100%), equivalent to scrap of JIS No. 2 copper wire.
Pretreatment for crude material: none
Refining process
Step (1) for melting
Melting furnace: 5-ton oil-fired reverberatory furnace
Amount of melt: 4 tons
Melting temperature: 1200±20° C.
Atmosphere for melting: air
Step (2a) for oxidation
Method of oxidation: air blowing toward the surface of the melt
Oxygen concentration in the melt after oxidation: 4000 ppm
Step (2b) for oxidation to give compound oxide
Agent: Fe
Amount of Fe added: 0.1 wt. % of the melt
Blowing of inert gas: none
Step (3) for slagging
Flux: none
Step ( 4 ) for reduction
Accomplished by scattering charcoal (1 wt. % of the melt) over the surface of the melt and then blowing argon into the melt at a flow rate of 10 l/min for 30 minutes through three porous plugs made of alumina ("isolite, MP-70" made by Isolite Kogyo Co., Ltd. 20 mm in diameter).
Results of experiment
Quality of the melt:
Content of impurity metals (Fe, Sn, Zn, Pb, Ni): less than 20 ppm each
Oxygen concentration: 190 ppm
Slagging performance: copper loss: 3%
Rating: good

EXAMPLE 2

Crude material: commercial scrap copper (100%), equivalent to scrap of JIS No. 2 copper wire.
Pretreatment for crude material: none
Refining process
Step ( 1 ) for melting
Melting furnace: 5-ton oil--fired reverberatory furnace
Amount of melt: 4 tons
Melting temperature: 1200±20° C.
Atmosphere for melting: air
Step (2a) for oxidation
Method of oxidation: air blowing toward the surface of the melt
Oxygen concentration in the melt after oxidation: 4000 ppm
Step (2b) for oxidation to give compound oxide
Agent: Fe
Amount of Fe added: 0.1 wt. % of the melt
Blowing of inert gas: none
Step (3) for slagging
Flux: $SiO_2$:80%, $Al_2O_3$:20%, 0.1 wt. % of the melt
Step (4) for reduction
Accomplished by scattering charcoal (1 wt. % of the melt) over the surface of the melt and then blowing argon into the melt at a flow rate of 10 l/min for 30 minutes through three porous plugs made of alumina (same as above).
Results of experiment
Quality of the melt:
Content of impurity metals (Fe, Sn, Zn, Pb, Ni): less than 20 ppm each
Oxygen concentration: 190 ppm
Slagging performance: copper loss: 2%
Rating: good

EXAMPLE 3

Crude material: commercial scrap copper (100%), equivalent to scrap of JIS No. 2 copper wire.
Pretreatment for crude material: none
Refining process
Step (1) for melting
Melting furnace: 5-ton oil--fired reverberatory furnace
Amount of melt: 4 tons
Melting temperature: 1200±20° C.
Atmosphere for melting: air
Step (2a) for oxidation
Method of oxidation: air blowing toward the surface of the melt
Oxygen concentration in the melt after oxidation: 4000 ppm
Step (2b) for oxidation to give compound oxide
Agent: Fe
Amount of Fe added: 0.1 wt. % of the melt
Blowing of inert gas: argon at a flow rate of 15 l/min for 10 minutes through a 4-mm lance
Step (3) for slagging
Flux: none Step (4) for reduction
Accomplished by scattering charcoal (1 wt. % of the melt) over the surface of the melt and then blowing argon into the melt at a flow rate of 10 l/min for 30 minutes through three porous plugs made of alumina (same as above).
Results of experiment
Quality of the melt:
Content of impurity metals (Fe, Sn, Zn, Pb, Ni): less than 20 ppm each
Oxygen concentration: 190 ppm
Slagging performance: copper loss: 2%
Rating: good

EXAMPLE 4

Crude material: commercial scrap copper (100%), equivalent to scrap of JIS No. 2 copper wire.
Pretreatment for crude material: none
Refining process
Step (1) for melting
Melting furnace: 5-ton oil--fired reverberatory furnace
Amount of melt: 4 tons
Melting temperature: 1200±20° C.
Atmosphere for melting: air
Step (2a) for oxidation
Method of oxidation: addition of CuO
Oxygen concentration in the melt after oxidation: 4000 ppm
Step (2b) for oxidation to give compound oxide
Agent: Fe
Amount of Fe added: 0.1 wt. % of the melt
Blowing of inert gas: argon at a flow rate of 15 l/min for 10 minutes through a 4-mm lance
Step (3) for slagging
Flux: $SiO_2$: 80%, $Al_2O_3$: 20%, 0.1 wt. % of the melt
Step (4) for reduction
Accomplished by scattering charcoal (1 wt. % of the melt) over the surface of the melt and then blowing argon into the melt at a flow rate of 10 l/min for 30 minutes through three porous plugs made of alumina (same as above).
Results of experiment
Quality of the melt:
Content of impurity metals (Fe, Sn, Zn, Pb, Ni): less than 20 ppm each
Oxygen concentration: 200 ppm
Slagging performance: copper loss: 2%
Rating: good The same procedure as in each of Examples 1 to 4 was repeated except that Fe was replaced by Mn in the step (2b). The results were almost identical to those mentioned above.

EXAMPLE 5

Crude material: commercial scrap copper (100%), equivalent to scrap of JIS No. 2 copper wire.
Pretreatment for crude material: none
Refining process
Step (1) for melting
Melting furnace: 5-ton oil--fired reverberatory furnace
Amount of melt: 4 tons
Melting temperature: 1200±20° C.
Atmosphere for melting: air
Step (2a) for oxidation
Method of oxidation: air blowing into the melt
Oxygen concentration in the melt after oxidation: 4000 ppm
Step (2b) for oxidation to give compound oxide
Agent: $Fe_2O_3$ (industrial grade)
Amount of $Fe_2O_3$ added: 2 wt. % of the melt
Blowing of inert gas: none
Step (3) for slagging
Flux: none
Step (4) for reduction
Accomplished by scattering charcoal (1 wt. % of the melt) over the surface of the melt and then blowing argon into the melt at a flow rate of 10 l/min for 30 minutes through three porous plugs made of alumina (same as above).
Results of experiment
Quality of the melt:
Content of impurity metals (Fe, Sn, Zn, Pb, Ni): less than 20 ppm each
Oxygen concentration: 200 ppm
Slagging performance: copper loss: 2%
Rating: good

EXAMPLE 6

Crude material: commercial scrap copper (100%), equivalent to scrap of JIS No. 2 copper wire.
Pretreatment for crude material: none
Refining process
Step (1) for melting
Melting furnace: 5-ton oil-fired reverberatory furnace
Amount of melt: 4 tons
Melting temperature: 1200±20° C.
Atmosphere for melting: air
Step (2a) for oxidation
Method of oxidation: air blowing into the melt
Oxygen concentration in the melt after oxidation: 4000 ppm
Step (2b) for oxidation to give compound oxide
Agent: $Fe_2O_3$ (industrial grade)
Amount of Fe added: 2 wt. % of the melt
Blowing of inert gas: none
Step (3) for slagging
Flux: $SiO_2$:80%, $Al_2O_3$: 20%, 0.1 wt. % of the melt
Step (4) for reduction
Accomplished by scattering charcoal (1 wt. % of the melt) over the surface of the melt and then blowing argon into the melt at a flow rate of 10 l/min for 30 minutes through three porous plugs made of alumina (same as above).
Results of experiment
Quality of the melt: less
Content of impurity metals (Fe, Sn, Zn, Pb, Ni): than 20 ppm each
Oxygen concentration: 200 ppm
Slagging performance: copper loss: 2%
Rating: good

EXAMPLE 7

Crude material: commercial scrap copper (100%), equivalent to scrap of JIS No. 2 copper wire.
Pretreatment for crude material: none
Refining process
Step (1) for melting
Melting furnace: 5-ton oil--fired reverberatory furnace
Amount of melt: 4 tons
Melting temperature: 1200±20° C.
Atmosphere for melting: air
Step (2a) for oxidation
Method of oxidation: oxygen blowing toward the surface of the melt
Oxygen concentration in the melt after oxidation: 4000 ppm Step (2b) for oxidation to give compound oxide
Agent: $Fe_2O_3$ (industrial grade)
Amount of $Fe_2O_3$ added: 2 wt. % of the melt
Blowing of inert gas: argon at a flow rate of 10 l/min for 10 minutes through a 4-mm lance.
Step (3) for slagging
Flux: none
Step (4) for reduction
Accomplished by scattering charcoal (1 wt. % of the melt) over the surface of the melt and then blowing argon into the melt at a flow rate of 10 l/min for 30 minutes through three porous plugs made of alumina (same as above).
Results of experiment
Quality of the melt:
Content of impurity metals (Fe, Sn, Zn, Pb, Ni): less than 20 ppm each
Oxygen concentration: 180 ppm
Slagging performance: copper loss: 3%
Rating: good

EXAMPLE 8

Crude material: commercial scrap copper (100%), equivalent to scrap of JIS No. 2 copper wire.
Pretreatment for crude material: none
Refining process
Step (1) for melting
Melting furnace: 5-ton oil--fired reverberatory furnace
Amount of melt: 4 tons
Melting temperature: 1200±20° C.
Atmosphere for melting: air
Step (2a) for oxidation
Method of oxidation: addition of CuO
Oxygen concentration in the melt after oxidation: 4000 ppm
Step (2b) for oxidation to give compound oxide
Agent: $Fe_2O_3$ (industrial grade)
Amount of $Fe_2O_3$ added: 2 wt. % of the melt
Blowing of inert gas: argon at a flow rate of 15 l/min for 10 minutes through a 4-mm lance.
Step (3) for slagging
Flux: $SiO_2$: 80%, $Al_2O_3$: 20%, 0.1 wt. % of the melt
Step (4) for reduction
Accomplished by scattering charcoal (1 wt. % of the melt) over the surface of the melt and then blowing argon into the melt at a flow rate of 10 l/min for 30 minutes through three porous plugs made of alumina (same as above).
Results of experiment
Quality of the melt:
Content of impurity metals (Fe, Sn, Zn, Pb, Ni): less than 20 ppm each
Oxygen concentration: 180 ppm
Slagging performance: copper loss: 2%
Rating: good The same procedure as in each of Examples 5 to 8 was repeated except that $Fe_2O_3$ was replaced by $Fe_3O_4$, FeO, $MnO_2$, or MnO in the step (2b). The results were almost identical to those mentioned above.

EXAMPLE 9

Crude material: commercial scrap copper (100%), equivalent to scrap of JIS No. 2 copper wire.
Pretreatment for crude material: none
Refining process
Step (1) for melting
Melting furnace: 3-ton channel--type induction furnace
Amount of melt: 2 tons
Melting temperature: 1200±20° C.
Atmosphere for melting: air
Step (2a) for oxidation
Method of oxidation: oxygen blowing into the melt and toward the surface of the melt.
Oxygen concentration in the melt after oxidation: 8000 ppm
Step (2b) for oxidation to give compound oxide
Agent: Fe
Amount of Fe added: 0.1 wt. % of the melt
Blowing of inert gas: none
Step (3) for slagging
Flux: none
Step (4) for reduction
Accomplished by scattering charcoal (1 wt. % of the melt) over the surface of the melt and then blowing argon into the melt at a flow rate of 8 l/min for 30 minutes through three porous plugs made of alumina (same as above).
Results of experiment
Quality of the melt:
Content of impurity metals (Fe, Sn, Zn, Pb, Ni): less than 20 ppm each
Oxygen concentration: 190 ppm
Slagging performance: copper loss: 2%
Rating: good

EXAMPLE 10

Crude material: commercial scrap copper (100%), equivalent to scrap of JIS No. 2 copper wire.
Pretreatment for crude material: none
Refining process
Step (1) for melting
Melting furnace: 3-ton channel-type induction furnace
Amount of melt: 2 tons
Melting temperature: 1200±20° C.
Atmosphere for melting: air
Step (2a) for oxidation
Method of oxidation: oxygen blowing toward the surface of the melt and addition of CuO
Oxygen concentration in the melt after oxidation: 8000 ppm
Step (2b) for oxidation to give compound oxide
Agent: Fe
Amount of Fe added: 0.1 wt. % of the melt
Blowing of inert gas: none
Step (3) for slagging
Flux: $SiO_2$:80%, $Al_2O_3$:20%, 0.1 wt. % of the melt
Step (4) for reduction
Accomplished by scattering charcoal (1 wt. % of the melt) over the surface of the melt and then blowing argon into the melt at a flow rate of 8 l/min for 30 minutes through two porous plugs made of alumina (same as above).
Results of experiment
Quality of the melt:
Content of impurity metals (Fe, Sn, Zn, Pb, Ni): less than 20 ppm each
Oxygen concentration: 190 ppm
Slagging performance: copper loss: 1 . 5%
Rating: good

EXAMPLE 11

Crude material: commercial scrap copper (100%), equivalent to scrap of JIS No. 2 copper wire.
Pretreatment for crude material: none
Refining process
Step (1) for melting Melting furnace: 3-ton channel-type induction furnace
Amount of melt: 2 tons
Melting temperature: 1200±20° C.
Atmosphere for melting: air
Step (2a) for oxidation
Method of oxidation: air blowing, together with CuO, into the melt
Oxygen concentration in the melt after oxidation: 8000 ppm
Step (2b) for oxidation to give compound oxide
Agent: Fe
Amount of Fe added: 0.1 wt. % of the melt
Blowing of inert gas: argon blowing through a 4-mm lance at a flow rate of 10 l/min for 10 minutes.
Step (3) for slagging
Flux: none
Step (4) for reduction
Accomplished by scattering charcoal (1 wt. % of the melt) over the surface of the melt and then blowing argon into the melt at a flow rate of 8 l/min for 30 minutes through two porous plugs made of alumina (same as above).
Results of experiment
Quality of the melt:
Content of impurity metals (Fe, Sn, Zn, Pb, Ni): less than 20 ppm each
Oxygen concentration: 200 ppm
Slagging performance: copper loss: 2%
Rating: good

EXAMPLE 12

Crude material: commercial scrap copper (100%), equivalent to scrap of JIS No. 2 copper wire.
Pretreatment for crude material: none
Refining process
Step (1) for melting
Melting furnace: 3-ton channel-type induction furnace
Amount of melt: 2 tons
Melting temperature: 1200±20° C.
Atmosphere for melting: air
Step (2a) for oxidation
Method of oxidation: oxygen blowing into the melt
Oxygen concentration in the melt after oxidation: 8000 ppm
Step (2b) for oxidation to give compound oxide
Agent: Fe
Amount of Fe added: 0.1 wt. % of the melt
Blowing of inert gas: argon blowing through a 4-mm lance at a flow rate of 10 l/min for 10 minutes.
Step (3) for slagging
Flux: $SiO_{2:80}$%, $Al_2O_3$:20%, 0.1 wt. % of the melt
Step (4) for reduction
Accomplished by scattering charcoal (1 wt. % of the melt) over the surface of the melt and then blowing argon into the melt at a flow rate of 8 l/min for 30 minutes through two porous plugs made of alumina (same as above).
Results of experiment
Quality of the melt:
Content of impurity metals (Fe, Sn, Zn, Pb, Ni): less than 20 ppm each
Oxygen concentration: 200 ppm
Slagging performance: copper loss: 1.5%
Rating: good The same procedure as in each of Examples 9 to 12 was repeated except that Fe was replaced by Mn in the step (2b). The results were almost identical to those mentioned above.

EXAMPLE 13

Crude material: commercial scrap copper (100%), equivalent to scrap of JIS No. 2 copper wire.
Pretreatment for crude material: none
Refining process
Step (1) for melting
Melting furnace: 3-ton channel-type induction furnace
Amount of melt: 2 tons
Melting temperature: 1200±20° C.
Atmosphere for melting: air
Step (2a) for oxidation
Method of oxidation: oxygen blowing into the melt
Oxygen concentration in the melt after oxidation: 8000 ppm
Step (2b) for oxidation to give compound oxide
Agent: $Fe_2O_3$ (industrial grade)
Amount of Fe added: 2 wt. % of the melt
Blowing of inert gas: none
Step (3) for slagging
Flux: none
Step (4) for reduction
Accomplished by scattering charcoal (1 wt. % of the melt) over the surface of the melt and then blowing argon into the melt at a flow rate of 8 l/min for 30 minutes through two porous plugs made of alumina (same as above).
Results of experiment
Quality of the melt:
Content of impurity metals (Fe, Sn, Zn, Pb, Ni):less than 20 ppm each
Oxygen concentration: 200 ppm
Slagging performance: copper loss: 2%
Rating: good

EXAMPLE 14

Crude material: commercial scrap copper (100%), equivalent to scrap of JIS No. 2 copper wire.
Pretreatment for crude material: none
Refining process
Step (1) for melting
Melting furnace: 3-ton channel-type induction furnace
Amount of melt: 2 tons
Melting temperature: 1200±20° C.
Atmosphere for melting: air
Step (2a) for oxidation
Method of oxidation: oxygen blowing into the melt
Oxygen concentration in the melt after oxidation: 8000 ppm
Step (2b) for oxidation to give compound oxide
Agent: $Fe_2O_3$ (industrial grade)
Amount of Fe added: 2 wt. % of the melt
Blowing of inert gas: none
Step (3) for slagging
Flux: $SiO_{2:80}$%, $Al_2O_3$:20%, 0.1 wt. % of the melt
Step (4) for reduction
Accomplished by scattering charcoal (1 wt. % of the melt) over the surface of the melt and then blowing argon into the melt at a flow rate of 8 l/min for 30 minutes through two porous plugs made of alumina (same as above).
Results of experiment
Quality of the melt:
Content of impurity metals (Fe, Sn, Zn, Pb, Ni): less than 20 ppm each
Oxygen concentration: 200 ppm
Slagging performance: copper loss: 1.5%
Rating: good

EXAMPLE 15

Crude material: commercial scrap copper (100%), equivalent to scrap of JIS No. 2 copper wire.
Pretreatment for crude material: none
Refining process
Step (1) for melting
Melting furnace: 3-ton channel-type induction furnace
Amount of melt: 2 tons
Melting temperature: 1200±20° C.
Atmosphere for melting: air
Step (2a) for oxidation
Method of oxidation: oxygen blowing into the melt
Oxygen concentration in the melt after oxidation: 8000 ppm
Step (2b) for oxidation to give compound Oxide
Agent: $Fe_2O_3$ (industrial grade)
Amount of Fe added: 2 wt. % of the melt
Blowing of inert gas: argon blowing into the melt through a 4-mm lance at a flow rate of 10 l/min for 10 minutes.
Step (3) for slagging
Flux: none
Step (4) for reduction
Accomplished by scattering charcoal (1 wt. % of the melt) over the surface of the melt and then blowing argon into the melt at a flow rate of 8 l/min for 30 minutes through two porous plugs made of alumina (same as above).
Results of experiment
Quality of the melt:
Content of impurity metals (Fe, Sn, Zn, Pb, Ni): less than 20 ppm each
Oxygen concentration: 190 ppm
Slagging performance: copper loss: 2%
Rating: good

EXAMPLE 16

Crude material: commercial scrap copper (100%), equivalent to scrap of JIS No. 2 copper wire.
Pretreatment for crude material: none
Refining process
Step (1) for melting
Melting furnace: 3-ton channel-type induction furnace
Amount of melt: 2 tons
Melting temperature: 1200±20° C.
Atmosphere for melting: air
Step (2a) for oxidation
Method of oxidation:oxygen blowing into the melt
Oxygen concentration in the melt after oxidation: 8000 ppm
Step (2b) for oxidation to give compound oxide
Agent: $Fe_2O_3$ (industrial grade)
Amount of Fe added: 2 wt. % of the melt
Blowing of inert gas: argon blowing into the melt through a 4-mm lance at a flow rate of 10 l/min for 10 minutes.
Step (3) for slagging
Flux: $SiO_2$:80%, $Al_2O_3$: 20%, 0.1 wt. % of the melt
Step (4) for reduction
Accomplished by scattering charcoal (1 wt. % of the melt) over the surface of the melt and then blowing argon into the melt at a flow rate of 8 l/min for 30 minutes through two porous plugs made of alumina (same as above).
Results of experiment
Quality of the melt:
Content of impurity metals (Fe, Sn, Zn, Pb, Ni): less than 20 ppm each
Oxygen concentration: 190 ppm
Slagging performance: copper loss: 1.5%
Rating: good The same procedure as in each of Examples 13 to 16 was repeated except that $Fe_2O_3$ was replaced by $Fe_3O_4$, FeO, $MnO_2$, or MnO in the step (2b). The results were almost identical to those mentioned above.

EXPLOITATION IN INDUSTRY

As mentioned above, the process of the present invention comprising the steps (1) to (4) permits the efficient removal of impurity elements (Pb, Ni, Sb, S, Bi, As, Fe, Sn, and Zn) from a crude material for copper or copper alloy, which is followed by the final reduction. Therefore, the present invention contributes to the effective industrial recycling of crude material for copper or copper alloy.

We claim:

1. A process for refining a crude material for copper or copper alloy which contains at least one species selected from the group consisting of Pb, Ni, Sb, S, Bi, and As which comprises the sequential steps of (1) melting a crude material for copper or copper alloy, (2) increasing the oxygen concentration in the melt and adding to the melt at least one species selected from the group consisting of Fe, Fe oxide, Mn, and Mn oxide, thereby causing said at least one species selected from the group consisting of Pb, Ni, Sb, S, Bi, and As in the melt to slag in the form of compound oxide of Fe and/or Mn, (3) removing the thus formed slag from the melt, and (4) subjecting the melt to reduction.

2. A process for refining a crude material for copper or copper alloy which contains at least one species selected form the group consisting of Pb, Ni, Sb, S, Bi and As in combination with at least one species selected from the group consisting of Sn, Fe, and Zn which comprises the sequential steps of (1) melting a crude material for copper or copper alloy, (2a) increasing the oxygen concentration in the melt, thereby oxidizing said at least one species selected from the group consisting of Sn, Fe, and Zn into slag, (2b) adding to the melt at least one species selected from the group consisting of Fe, Fe oxide, Mn, and Mn oxide, thereby causing said at least one species selected from the group consisting of Pb, Ni, Sb, S, Bi, and As in the melt to slag in the form of compound oxide of Fe and/or Mn, (3) removing the thus formed slag from the melt, and (4) subjecting the melt to reduction.

3. A refining process as defined in claim 1 or 2, wherein the step (2) or the step (2a) or (2b) is carried out such that the oxygen concentration in the melt increases to 500 ppm or above.

4. A refining process as defined in claim 1 or 2, wherein the step (2) or (2b) involves the addition to the melt of at least one species of Fe, Fe oxide, Mn, and Mn oxide in an amount of 10–50,000 ppm of the weight of the melt.

5. A refining process as defined in claim 4, wherein the step (2) or (2b) involves the addition of at least one species of Fe, Fe oxide, Mn, and Mn oxide to the surface of the melt.

6. A refining process as defined in claim 5, wherein the step (2) or (2b) involves the stirring of the melt.

7. A refining process as defined in claim 4, wherein the step (2) or (2b) involves the blowing of at least one species of Fe, Fe oxide, Mn, and Mn oxide into the melt.

8. A refining process as defined in any of claim 4, wherein the step (2) or (2b) forms slag in the form of solid or half-molten double oxide which floats on the surface of the melt.

9. A refining process as defined in claim 6, wherein the step (2) or (2b) involves, after the formation of compound oxide, the standing of the melt before the step (3) for slag removal.

10. A refining process as defined in claim 1 or 2, wherein said slag contains $Cu_2O$ and wherein the step (3) involves the heating of said slag above the melting point of $Cu_2O$ so that said $Cu_2O$ in the slag changes into Cu which returns to the melt before slag removal.

11. A refining process as defined in claim 1 or 2, wherein the step (3) involves the addition of an $SiO_2$—$Al_2O_3$ flux which attracts slag to facilitate slag removal.

12. A refining process as defined in claim 11, wherein the $SiO_2$—$Al_2O_3$ flux consists of 70–90 parts by weight of $SiO_2$ and 30–10 parts by weight of $Al_2O_3$, with their total amount being 100 parts by weight.

13. A refining process as defined in claim 11, wherein the $SiO_2$—$Al_2O_3$ flux is added in an amount of 0.005–0.10 wt. % of the total weight of the melt.

14. A refining process as defined in claim 1 or 2, wherein the step (4) for reduction involves the addition of a reducing agent to the surface of the melt and the blowing of an inert gas into the melt and/or toward surface of the melt.

15. A refining process as defined in claim 14, wherein the reducing agent is a solid one.

16. A refining process as defined in claim 5, wherein the step (2) or (2b) forms slag in the form of solid or half-molten double oxide which floats on the surface of the melt.

17. A refining process as defined in claim 6, wherein the step (2) or (2b) forms slag in the form of solid or half-molten double oxide which floats on the surface of the melt.

18. A refining process as defined in claim 7, wherein the step (2) or (2b) forms slag in the form of solid or half-molten double oxide which floats on the surface of the melt.

19. A refining process as defined in claim 7, wherein the step (2) or (2b) involves, after the formation of compound oxide, the standing of the melt before the step (3) for slag removal.

20. A refining process as defined in claim 8, wherein the step (2) or (2b) involves, after the formation of compound oxide, the standing of the melt before the step (3) for slag removal.

21. A refining process as defined in claim 16, wherein the step (2) or (2b) involves, after the formation of compound oxide, the standing of the melt before the step (3) for slag removal.

22. A refining process as defined in claim 17, wherein the step (2) or (2b) involves, after the formation of compound oxide, the standing of the melt before the step (3) for slag removal.

23. A refining process as defined in claim 18, wherein the step (2) or (2b) involves, after the formation of compound oxide, the standing of the melt before the step (3) for slag removal.

24. A refining process as defined in claim 12, wherein the $SiO_2$—$Al_2O_3$ flux is added in an amount of 0,005–0.10 wt.% of the total weight of the melt.

* * * * *